US012397889B2

(12) United States Patent
Sharrow

(10) Patent No.: US 12,397,889 B2
(45) Date of Patent: Aug. 26, 2025

(54) DUO-PROPELLERS AND SINGLE PROPELLERS

(71) Applicant: Sharrow Engineering LLC, Philadelphia, PA (US)

(72) Inventor: Gregory C. Sharrow, Grosse Pointe Park, MI (US)

(73) Assignee: Sharrow Engineering LLC, St. Clair Shores, MI (US)

( * ) Notice: Subject to any disclaimer, the term of this patent is extended or adjusted under 35 U.S.C. 154(b) by 581 days.

(21) Appl. No.: 17/726,468

(22) Filed: Apr. 21, 2022

(65) Prior Publication Data

US 2022/0340247 A1 Oct. 27, 2022

Related U.S. Application Data

(60) Provisional application No. 63/300,887, filed on Jan. 19, 2022, provisional application No. 63/177,645, filed on Apr. 21, 2021.

(51) Int. Cl.
*B63H 1/26* (2006.01)
*B63H 5/10* (2006.01)

(52) U.S. Cl.
CPC ..... *B63H 1/265* (2013.01); *B63H 5/10* (2013.01)

(58) Field of Classification Search
CPC ..... B63H 1/265; B63H 5/10
See application file for complete search history.

(56) References Cited

U.S. PATENT DOCUMENTS

| | | | |
|---|---|---|---|
| 467,322 | A | 1/1892 | Myers |
| 467,323 | A | 1/1892 | Myers |
| 680,671 | A | 8/1901 | Brewster |
| 838,313 | A | 12/1906 | Fola |
| 868,220 | A | 10/1907 | Portelli |
| 1,831,366 | A | 11/1931 | Reed |
| 1,868,113 | A | 7/1932 | Ljungstrom |
| 2,045,383 | A | 6/1936 | Faber |
| 2,273,756 | A | 2/1942 | Hoenrkamp |
| 2,344,266 | A | 3/1944 | Reissner |
| 2,425,353 | A | 8/1947 | Spitzer, Jr. |
| 2,473,665 | A | 6/1949 | Van Nort |

(Continued)

FOREIGN PATENT DOCUMENTS

| | | | |
|---|---|---|---|
| CA | 37791 | A | 11/1891 |
| CA | 39504 | A | 7/1892 |

(Continued)

OTHER PUBLICATIONS

George Weiss, Flower Turbine in Turbulent Wind, uploaded Dec. 12, 2011, http://www.youtube.com/watch?v=MQauF49MjTg&list-UL.

(Continued)

*Primary Examiner* — Stephen P Avila
(74) *Attorney, Agent, or Firm* — Barnes & Thornburg LLP; Steven D. Shipe

(57) ABSTRACT

A duo propeller disclosed having a forward propeller having increased loading distribution and high swirl near the tip. The duo propeller has an aft propeller with a more optimal loading distribution that can cancel the high tip swirl from the forward propeller. The duo-propeller an enhanced ability for the aft propeller to capture the energy lost to the swirling flow of the forward propeller's outflow.

28 Claims, 36 Drawing Sheets

(56) References Cited

U.S. PATENT DOCUMENTS

| | | | | |
|---|---|---|---|---|
| 2,687,182 | A | 8/1954 | Hogan | |
| 3,087,553 | A | 4/1963 | Kostyun | |
| 3,485,462 | A | 12/1969 | Spence | |
| 3,504,990 | A | 4/1970 | Sugden | |
| 3,782,857 | A | 1/1974 | Svilans | |
| 4,445,817 | A | 5/1984 | Wethem | |
| 5,111,576 | A | 5/1992 | Kuhnle et al. | |
| 5,161,953 | A | 11/1992 | Burtis | |
| 5,190,441 | A * | 3/1993 | Murphy | B64C 11/008 416/201 A |
| 5,269,647 | A | 12/1993 | Moser | |
| 5,405,246 | A | 4/1995 | Goldberg | |
| 5,411,330 | A | 5/1995 | Arutyunov | |
| 5,632,658 | A | 5/1997 | Chen | |
| 5,890,875 | A | 4/1999 | Silvano | |
| 6,099,256 | A | 8/2000 | Silvano | |
| 6,247,897 | B1 | 6/2001 | Patel | |
| 6,364,614 | B1 | 4/2002 | Mnatsakanian | |
| 6,524,073 | B2 | 2/2003 | Winatsakanian | |
| 6,736,600 | B1 | 5/2004 | Bannasch | |
| 6,948,910 | B2 | 9/2005 | Polacsek | |
| 7,018,167 | B2 | 3/2006 | Yoshida | |
| D600,641 | S | 9/2009 | Starck | |
| D630,724 | S | 1/2011 | Liu | |
| 2004/0009063 | A1 | 1/2004 | Polacsek | |
| 2004/0067138 | A1 | 4/2004 | Yoshida | |
| 2008/0075599 | A1 | 3/2008 | Miller | |
| 2009/0147757 | A1 | 6/2009 | Naka et al. | |
| 2011/0200445 | A1 | 8/2011 | Takada et al. | |
| 2011/0299991 | A1 | 12/2011 | Shpadi et al. | |
| 2012/0056041 | A1 | 3/2012 | Rhee | |
| 2012/0288374 | A1 | 11/2012 | Avellan | |
| 2014/0161622 | A1 | 6/2014 | Sharrow | |
| 2015/0037157 | A1 | 2/2015 | Tzeng | |
| 2015/0284071 | A1 | 10/2015 | Veilleux, Jr. et al. | |
| 2018/0186439 | A1 | 7/2018 | Sharrow | |

FOREIGN PATENT DOCUMENTS

| | | | |
|---|---|---|---|
| DE | 3723101 | A1 | 2/1989 |
| DE | 102011016141 | A1 | 9/2012 |
| EP | 0898548 | B1 | 5/2001 |
| EP | 1365106 | A1 | 11/2003 |
| FR | 339176 | A | 12/1904 |
| FR | 357655 | A | 1/1906 |
| FR | 808801 | A | 2/1937 |
| FR | 2609506 | B1 | 5/1993 |
| GB | 427493 | A | 4/1935 |
| JP | 2003503643 | A | 1/2003 |
| JP | 2008090548 | A | 4/2008 |
| JP | 5690564 | B2 | 3/2015 |
| KR | 10-2010-0128928 | A | 12/2010 |
| KR | 20110119242 | B1 | 12/2011 |
| KR | 10-2014-0013199 | A | 2/2014 |
| RU | 2585180 | C1 | 5/2016 |
| WO | 2002059464 | A1 | 1/2002 |
| WO | 2009147757 | A1 | 12/2009 |
| WO | 2010053450 | A2 | 5/2010 |
| WO | 2011081577 | | 7/2011 |
| WO | 2012050441 | A1 | 4/2012 |

OTHER PUBLICATIONS

George Weiss, Closed Loop inclinded blades of HAWT for turbulent airflow, uploaded Dec. 10, 2011, http://www.youtube.com/watch?v=jlOs4z6lhUM.

M. Gilinsky; John M. Seigner; and Gloyd D. Backley, Screws, Propellers, and Fans based on the Mobius Strip, 4th AIAA/CEAS Aeroacoustics Conference, Jun. 2-4, 1988, pp. 1-10, Toulouse, Grance.

Quentin R. Wald; The arodynamics of propellers, Progress in Aerospace Sciences, Feb. 2006, Abstract Only, vol. 42, Issue 2, 102 Cape George Road, Port Townsend, WA 98368, USA.

Parag R. Gogate; Anthony A.C.M. Beenackers; Aniruddha B. Pandit, Multiple-impeller systems with a special emphasis on bioreactors; a critical review, Biochemical Engineering Journal, Oct. 2000, Abstract Only, vol. 6, Issue 2.

Ekinci, Serkan: A Practical Approach for Design of Marine Propellers with Systematic Propeller Series, Brodogradnja, 62(2011)2, pp. 123-129.

Miller, Marlin, L. Blade Frequency Thrust and Torque on a Loop-Bladed Propeller, David W. Taylor Naval SHip Research and Development Center, Ship Performance Departmental Report No. SPD-530-06, Nov. 1975, Bethesda, Maryland.

Crown, D.E. and Hendrican A.L., Cavitation Performance of Loop-Bladed Propeller 4667, Naval Ship Research Deveopment Center, Ship Performance Departmental Report No. SPD-530-05, Jul. 1975, Bethesda, Maryland.

Okamoto, H., et al., Cavitation Study of Decuted Propellers on Large Ships, Society of Naval Architects and Marine Engineers, pp. 168-190, New Jersey, 1975.

Klein I: "Bionik fur die maritime Wirtschaft", Offshore & Meerestrchnik Kompakt, Schiff & Hafen, Seehafen Verlag GMBH, DE, vol. 59, No. 3, Jan. 1, 2007, p. 90-9 XP001542137, ISSN: 1436-8498.

Min-Fu Hsieh et al.: "Integrated Design and Realization of a Hubless Rim-driven Thruster", Department of Systems and Naval Mechantronic Engineering, National Chen Kung University, The 33rd Annual Conference of the IEEE Industrial Electronics Society (IECON) Nov. 5-8, 2007,m Taipei, Taiwan.

Chung Wei Lee et al.: "The Characteristics of Rim-driven Propulsor's Flow Field", Department of Systems and Naval Mechanotronic Engineering, National Chen Kung University, Taiwan (2011 or earlier).

International Search Report and Written Opinion mailed Jan. 25, 2023 in International Patent Application PCT/US2022/025848.

First Office action issued in Chinese Patent Application No. 202110123604.5 on Feb. 11, 2023.

European Supplementary Search Report dated Feb. 20, 2025, EP Application No. 22808025.5.

* cited by examiner

TYPE 1 (RH SHOWN)

TYPE 2 (RH SHOWN)

- BLADE WAKE DOES NOT CROSS
- INLET AND OUTLET AT DIFFERENT AXIAL LEVELS

- BLADE WAKE DOES NOT CROSS
- INLET AND OUTLET AT SAME AXIAL LEVELS

- BLADE WAKE DOES CROSS
- INLET AND OUTLET AT DIFFERENT AXIAL LEVELS

DUO-PROPELLERS AND SINGLE PROPELLERS

BACKGROUND

Contra-rotating (CR) propeller solutions, in which two propeller operate in series on co-axial counter rotating shafts, rotating in opposite directions, have been developed. CR propellers are also referred to as "duo-prop" or "coaxial contra-rotating" propellers. A single engine can drive the two propellers, transferring power through a gear assembly.

Ideally, the energy lost to the swirling flow of the forward propeller's outflow is captured by the second aft-ward propeller, which is configured to utilize that outflow to improve overall system performance. The amount of swirl energy generated by the forward propeller depends in part on the loading at the tip of the propeller blades. In conventional propellers, the amount of feasible loading is limited by the creation of vortices that can cause drag. Additionally, the fluid flow generated by the forward propeller can interfere with the operation of the aft propeller, producing limitations on the diameter of the aft propeller in relation to the forward propeller. In traditional propellers the aft prop diameter is limited to a diameter equal to or less than the forward prop to prevent impingement of tip vortices on the aft prop blades, which can be a source of cavitation, noise, and vibration.

Accordingly, there is a need for a duo-propeller having a forward propeller with improved loading and higher swirl and an aft propeller with a more optimal loading distribution to cancel the high tip swirl from the forward propeller.

SUMMARY OF THE INVENTION

A duo propeller is disclosed having a forward propeller with a more optimal loading distribution and higher swirl near the tip than a traditional propeller. The duo propeller also may have an aft propeller with a more optimal loading distribution that can cancel the high tip swirl from the forward propeller.

The rake values and skew values of the propeller blades together form a loop-shaped blade having an inlet root and an outlet root attached to a hub. The inlet root and the outlet root spaced apart on the hub such that a portion of the hub is part of the loop. This structure minimizes vortices at the blade tips.

Embodiments of the duo-propeller provide increased swirling compared to conventional propellers and enhanced ability for the aft propeller to capture the energy lost to the swirling flow of the forward propeller's outflow. Unlike a conventional propeller, the amount of feasible loading near the tip is not limited by the creation of tip vortices that can cause drag. Additionally, disclosed propeller designs reduce the interference of the fluid flow generated by the forward propeller with the efficiency of the aft propeller. Thus, standard limitations on the diameter of the aft propeller in relation to the forward propeller do not apply. This allows the aft propeller to be larger or equal in diameter to the forward propeller, although the duo-propeller would still have efficiency advantages over conventional duo-propellers if the aft propeller and forward propeller were of equal diameter.

DESCRIPTION OF DRAWINGS

The detailed description refers to the accompanying figures, which depict illustrative embodiments, and in which.

4A-F depict measurements of rake for parameter sections in the intake portion, tip portion and exhaust portion of a propeller blade.

FIGS. 5A-F depict measurements for skew angle and vertical angle of parameter sections in the intake portion, tip portion and exhaust portion of a propeller blade.

FIGS. 6A-D depict examples of alpha (vertical angle) and radius values for selected parameter sections.

FIGS. 7A-F depict pitch angles for selected parameter sections of the blades.

Figure 8A:
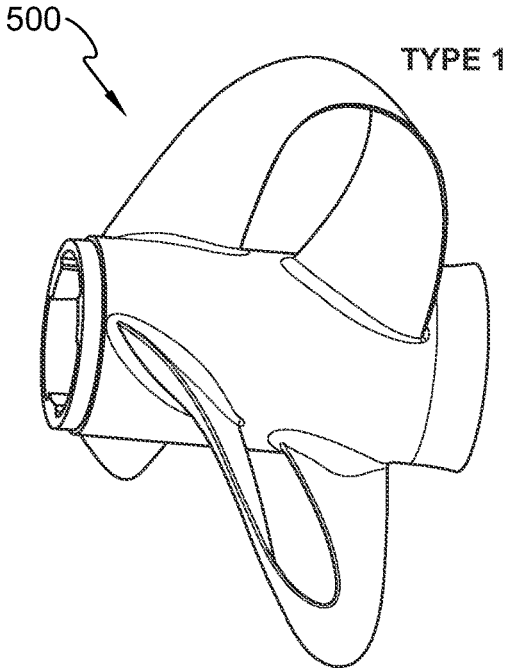
Figure 8B:
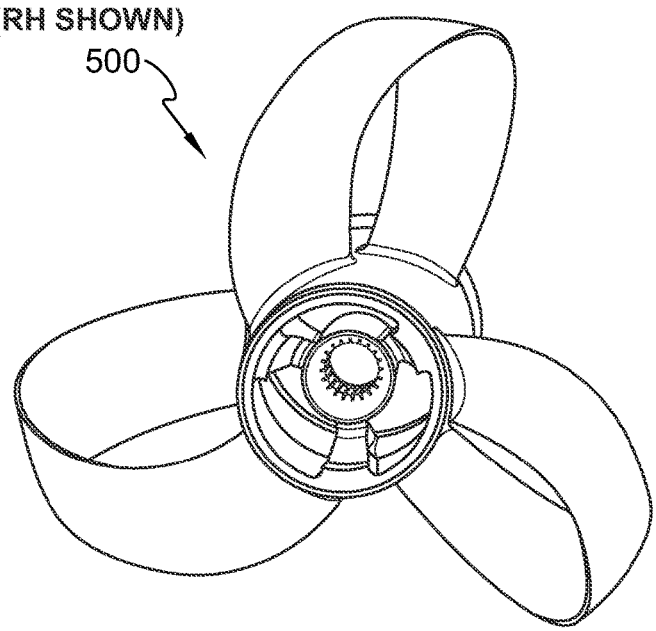

FIGS. 8A, 8B depict a propeller that will be referred to as a "Type 1" propeller.

Figure 9A:
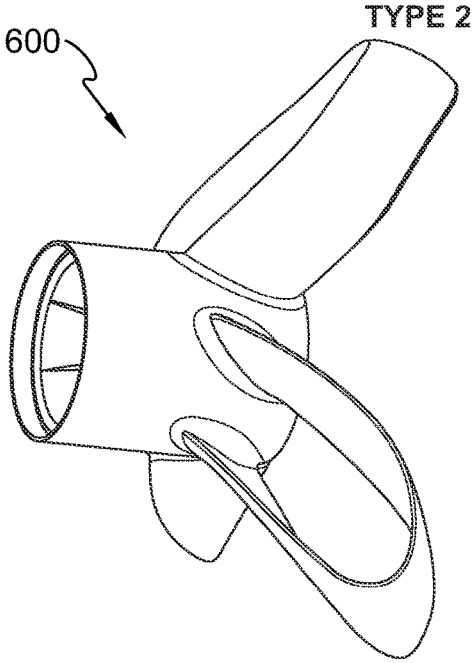
Figure 9B:
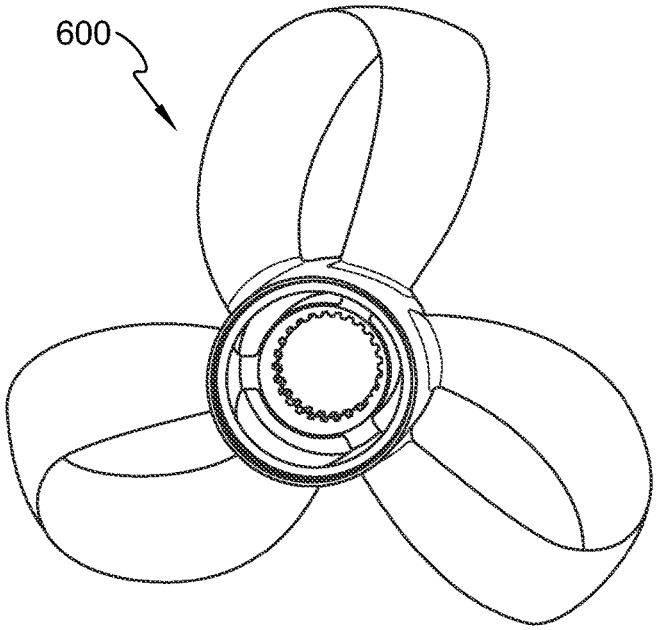

FIGS. 9A, 9B depict a propeller, that will be referred to as a "Type 2" propeller.

Figure 10:
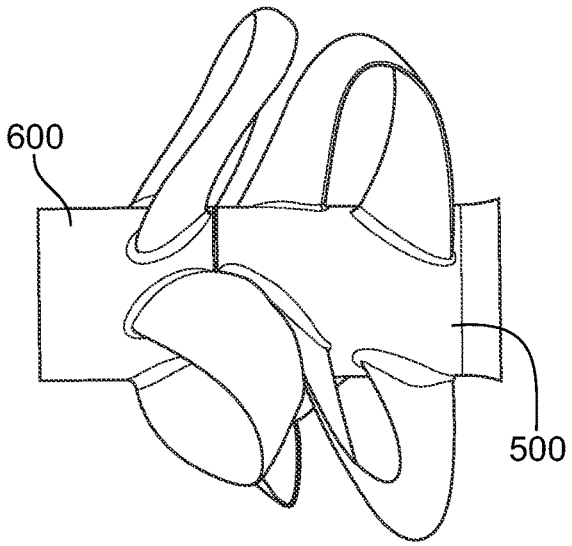

FIG. 10 depicts a duo-propeller with comprising a Type 2 forward propeller and a Type 1 aft propeller.

Figure 11:
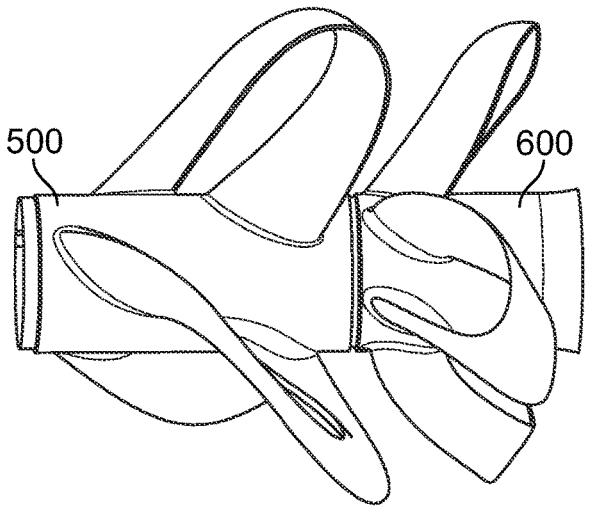

FIG. 11 depicts a duo-propeller with comprising a Type 1 forward propeller and a Type 2 aft propeller.

Figure 12:
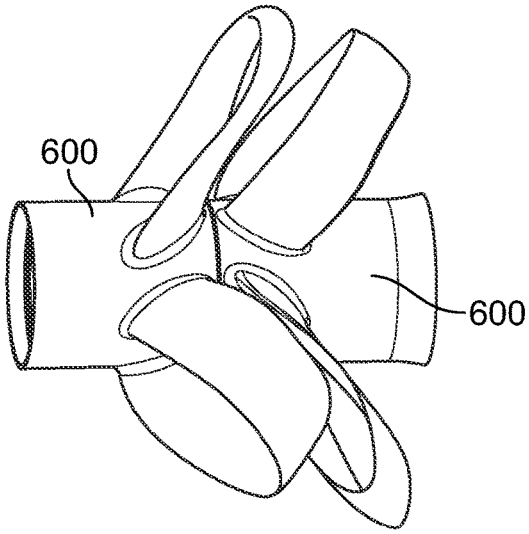

FIG. 12 depicts a duo-propeller with comprising a Type 2 forward propeller and a Type 2 aft propeller.

Figure 13:
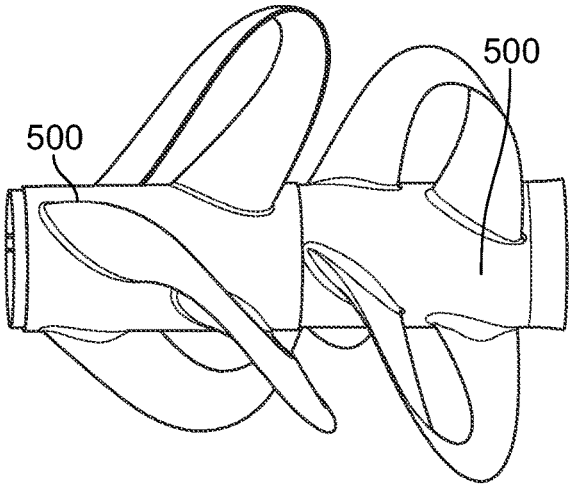

FIG. 13 depicts a duo-propeller with comprising a Type 1 forward propeller and a Type 1 aft propeller.

Figure 14:
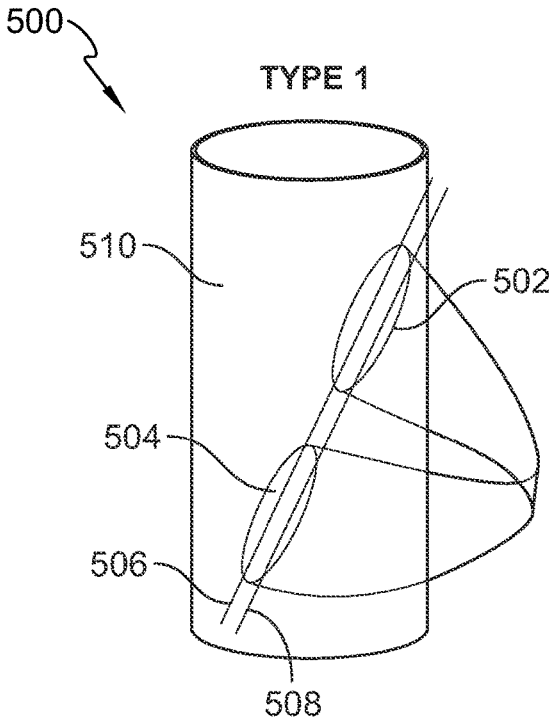

FIG. 14 depicts a Type 1 propeller showing its wake.

Figure 15:
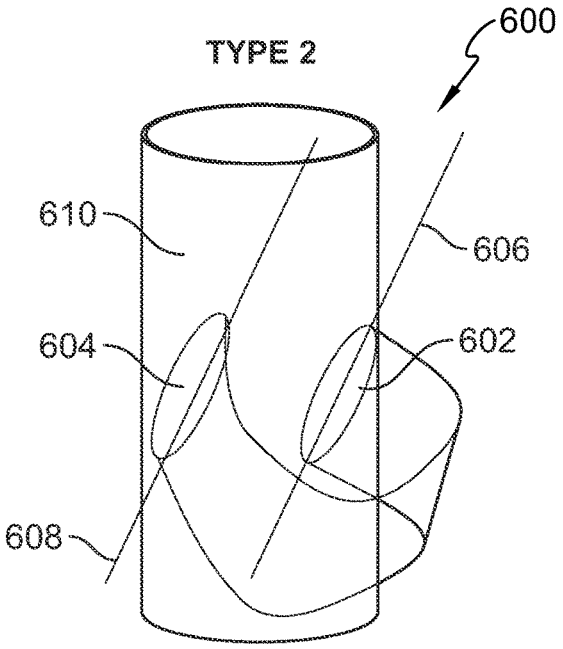

FIG. 15 depicts a Type 2 propeller showing its wake.

Figure 16:
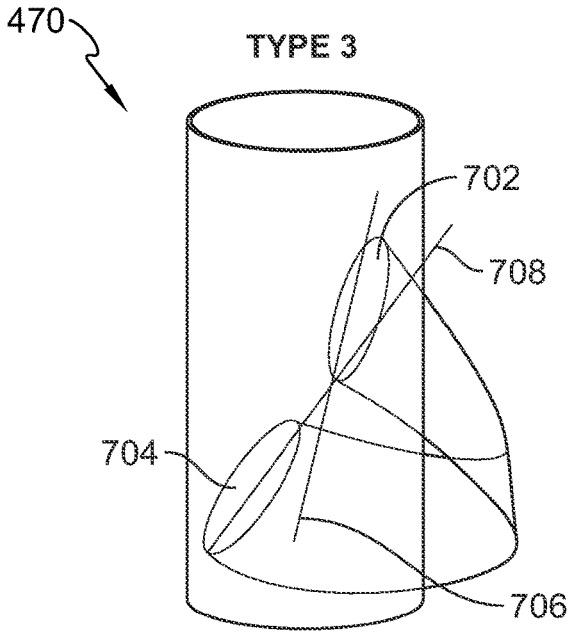

FIG. 16 depicts a Type 3 propeller showing its wake.

Figure 17:
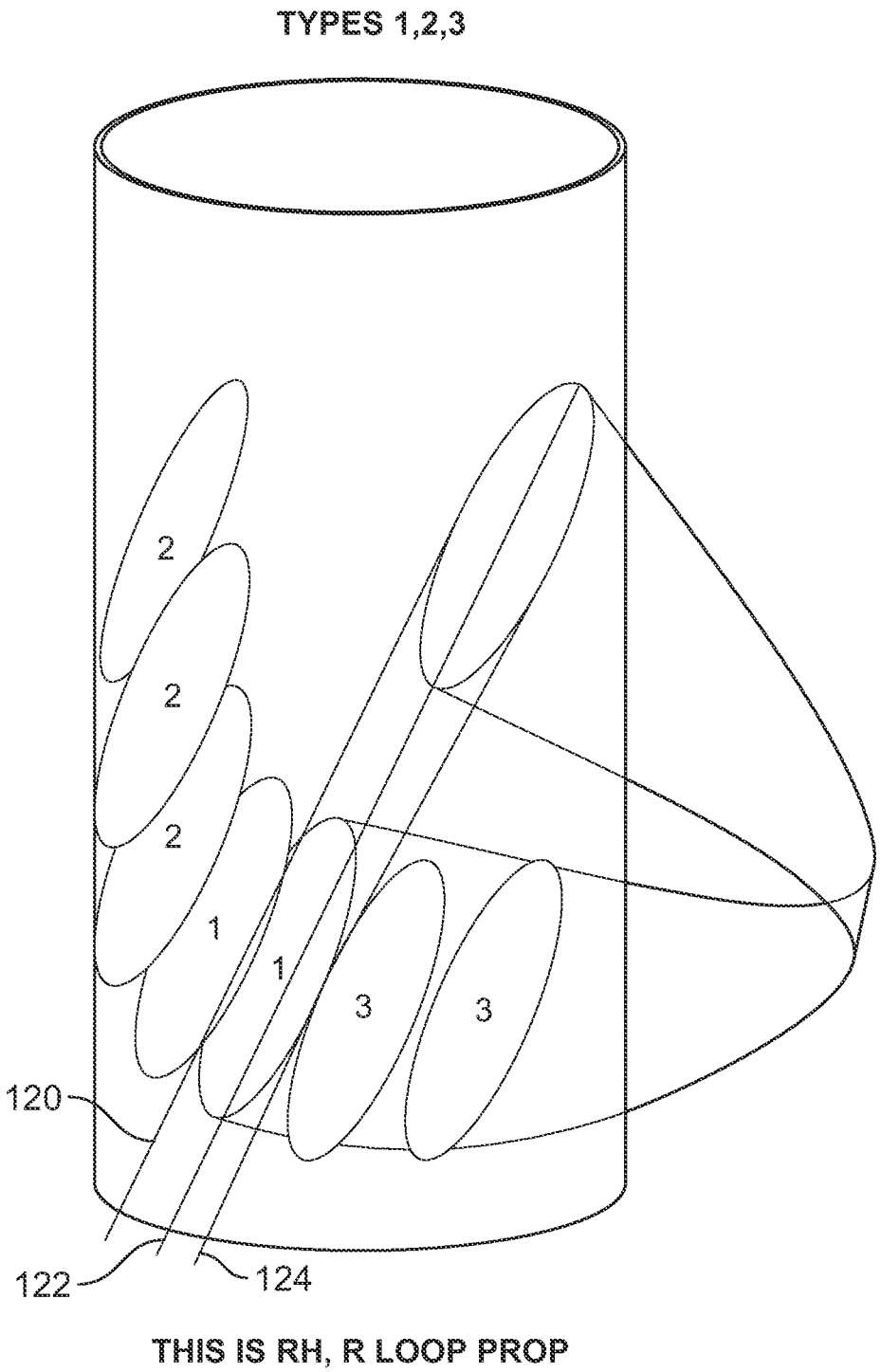

FIG. 17 depicts a right-handed, right loop propeller, showing various possible positions of the inlet root for Type 1, Type 2 and Type 3 propellers.

Figure 18A:
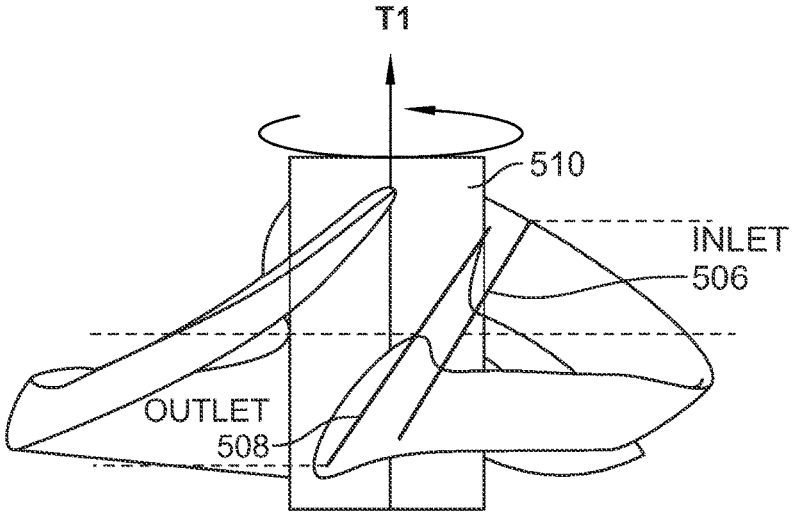
Figure 18B:
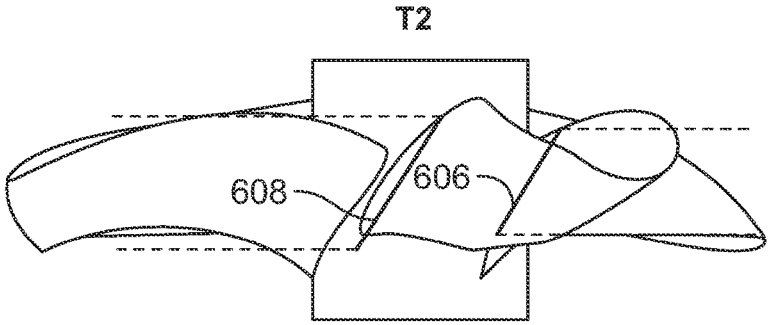
Figure 18C:
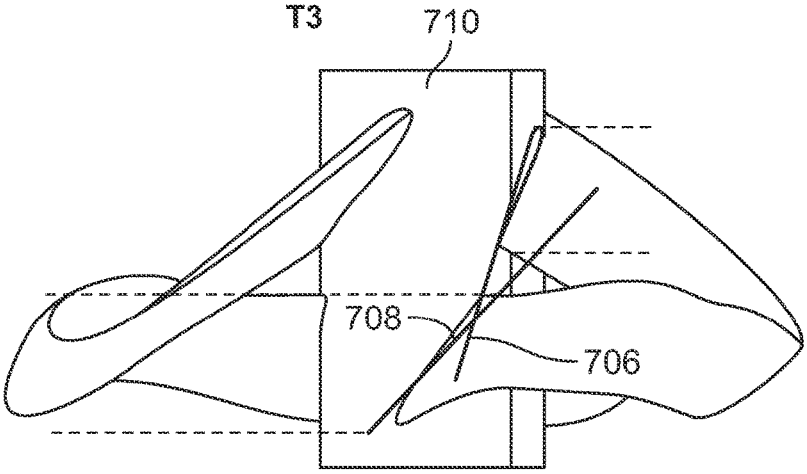

FIGS. 18A-C depict Type 1, Type 2 and Type 3 blade types.

Figure 19B:
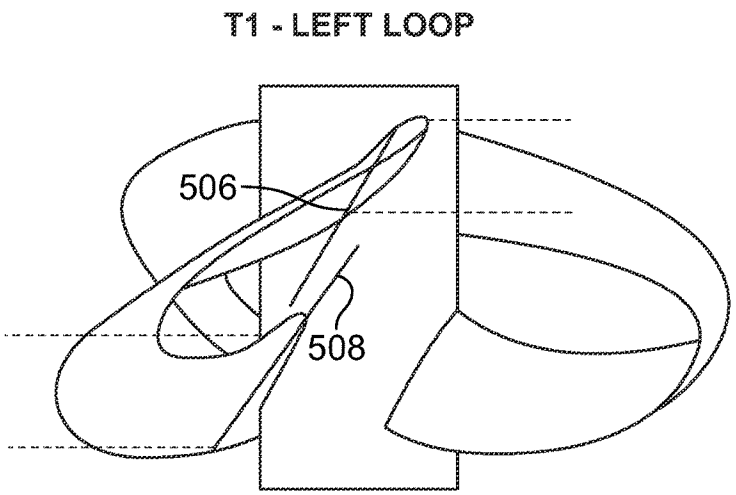
Figure 19A:
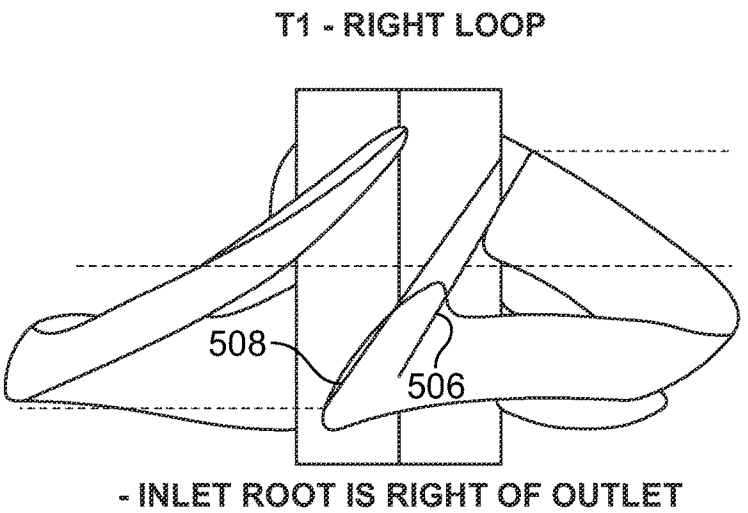

FIGS. 19A, 19B show the blade loop direction for a Type 1 propeller.

Figure 20B:
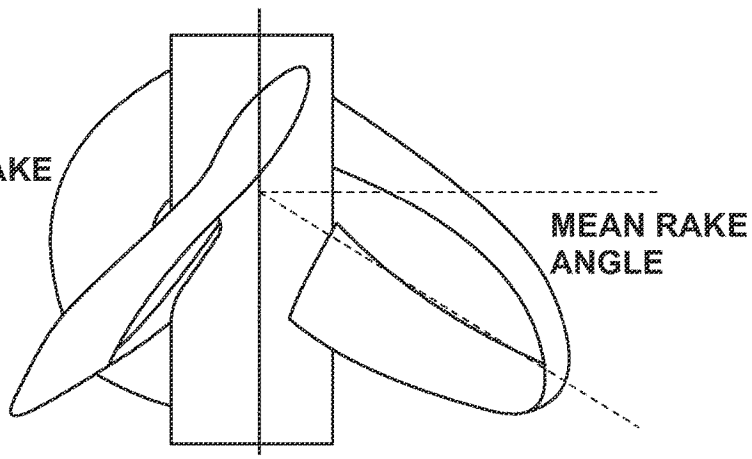
Figure 20A:
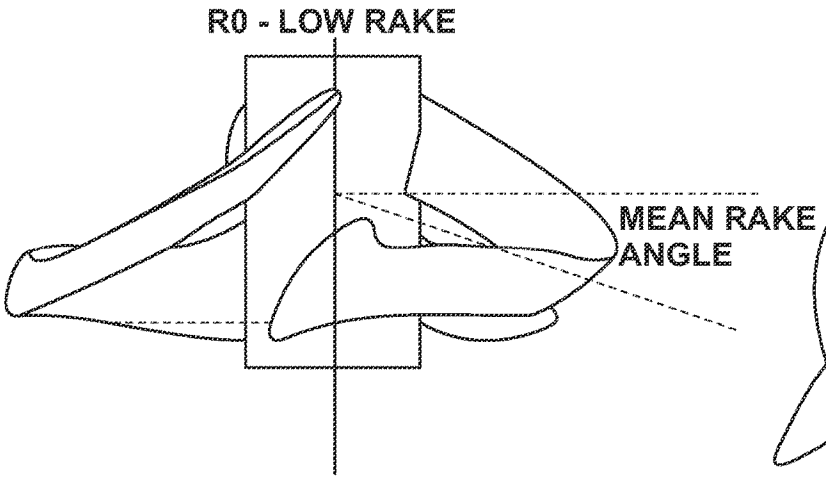

FIGS. 20A, 20B illustrate low and high rake.

Figure 21A:
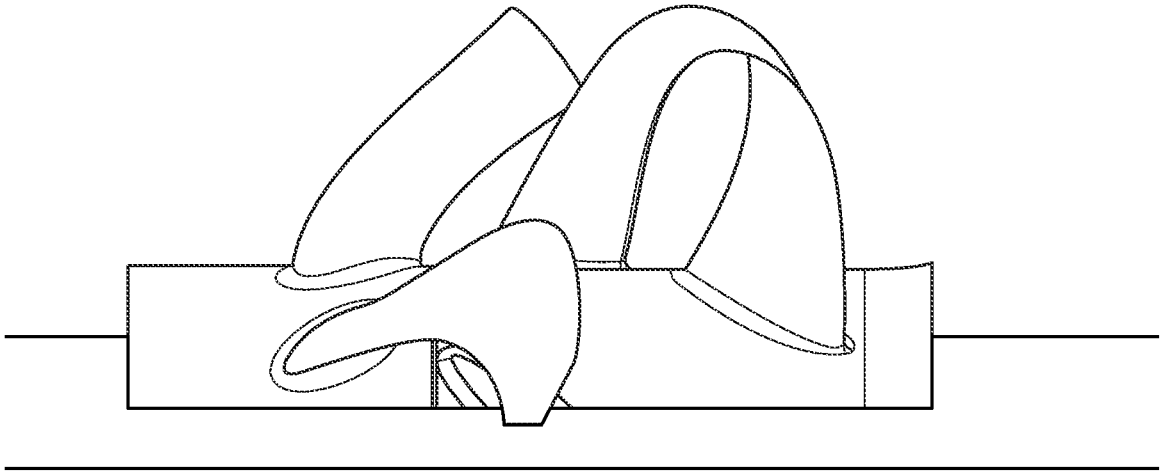
Figure 21B:
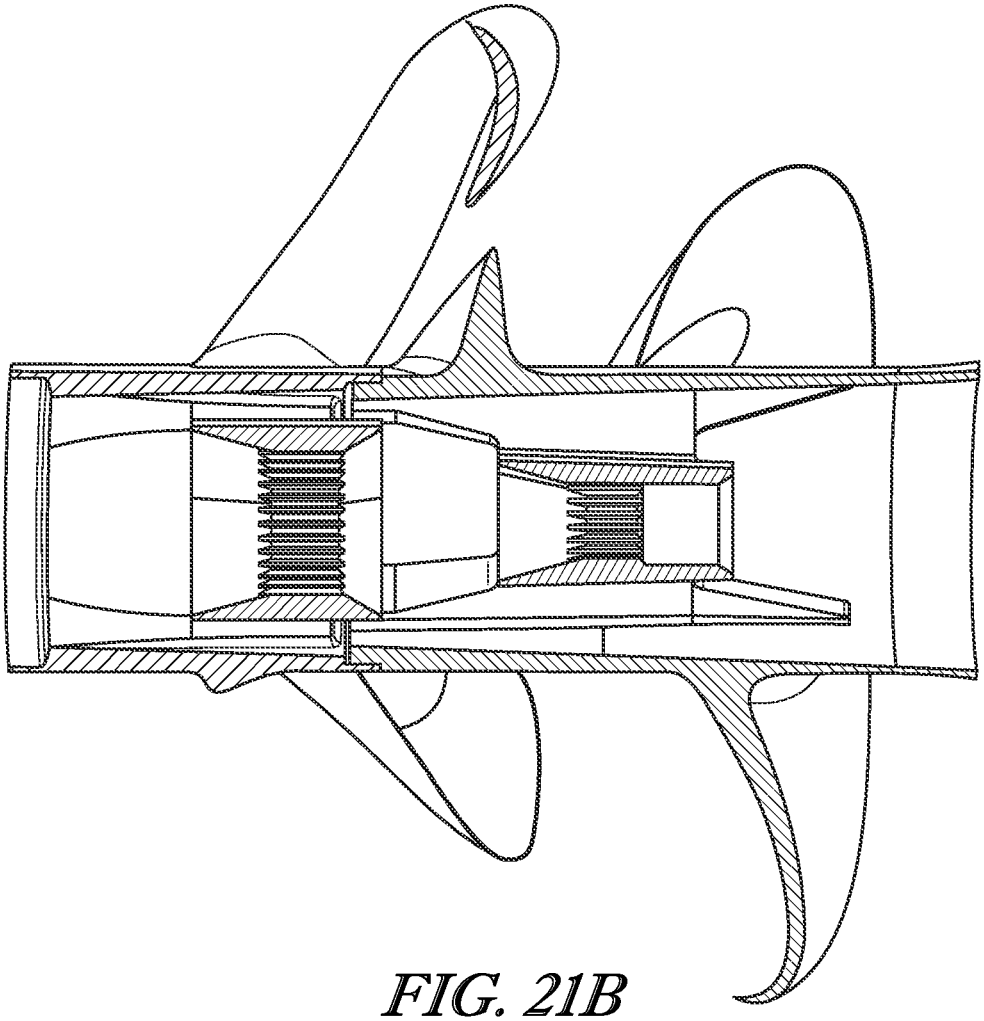

FIGS. 21A, 21B depict cross-sections of a CR propeller showing an illustrative gear assembly that can be employed to rotate both propellers.

Figure 22:
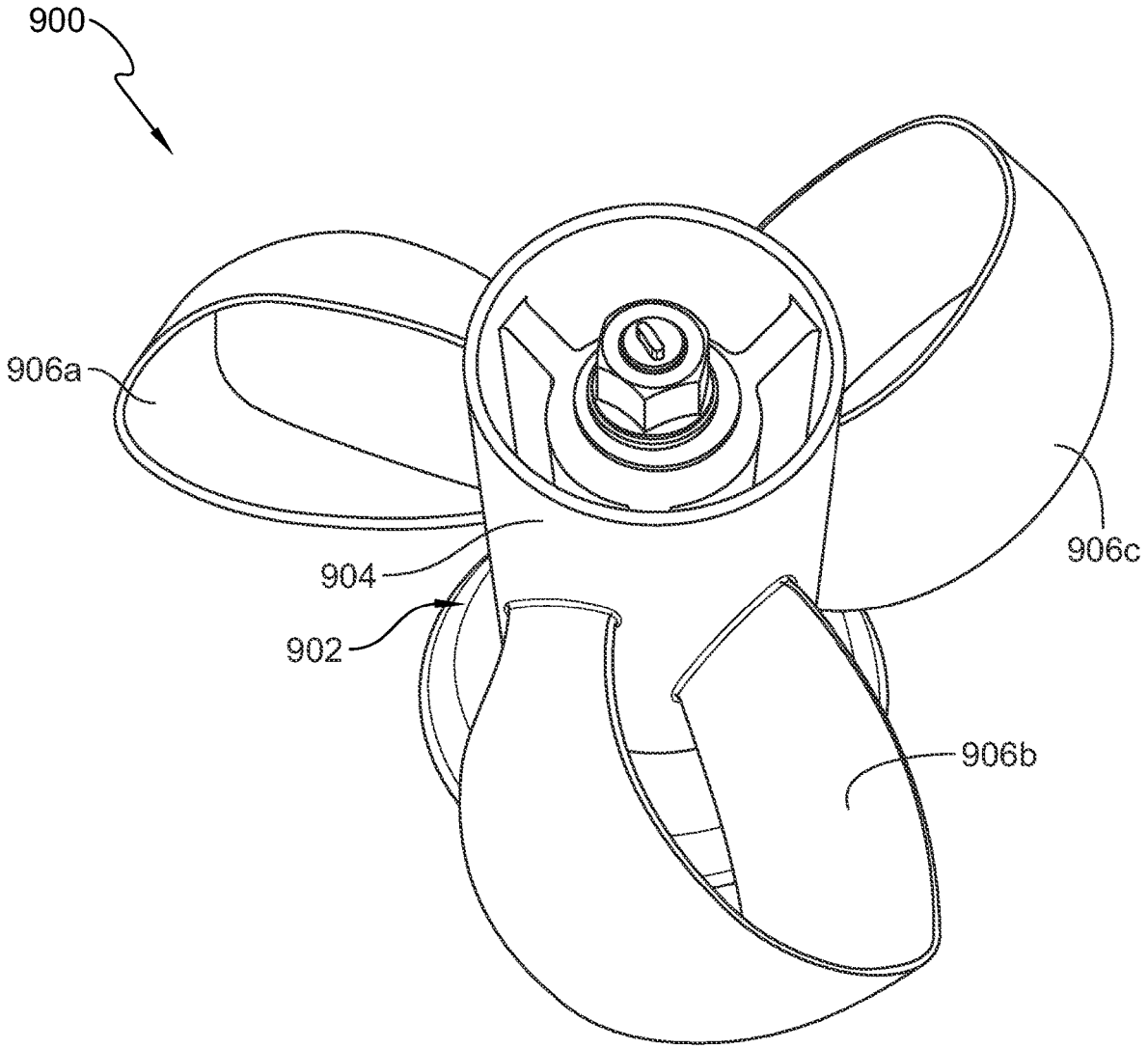

FIG. 22 depicts an illustrative through-hub exhaust propeller.

Figure 23:
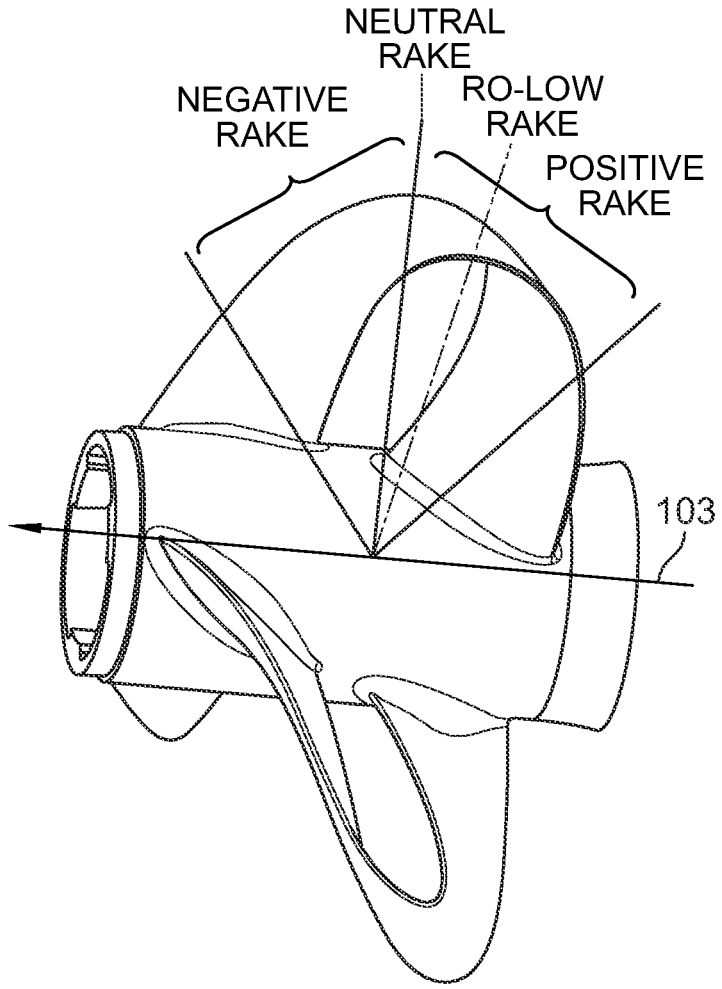

FIG. 23 shows ranges of positive and negative rake angles on either side of neutral rake.

Figure 24:
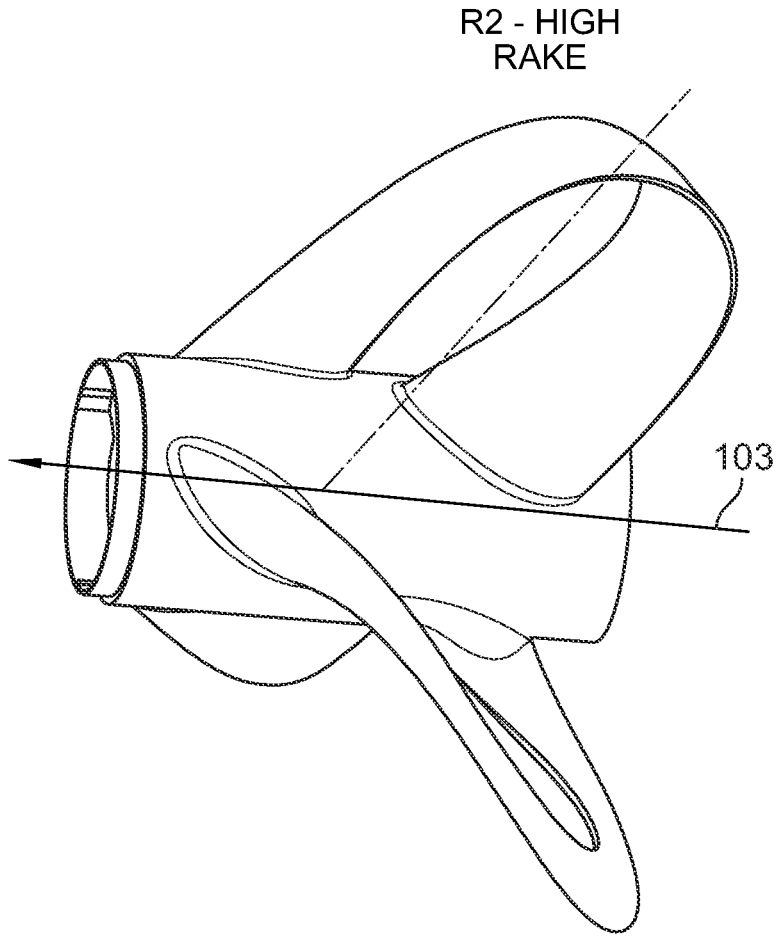

FIG. 24 further illustrates rake angle.

Figure 25:
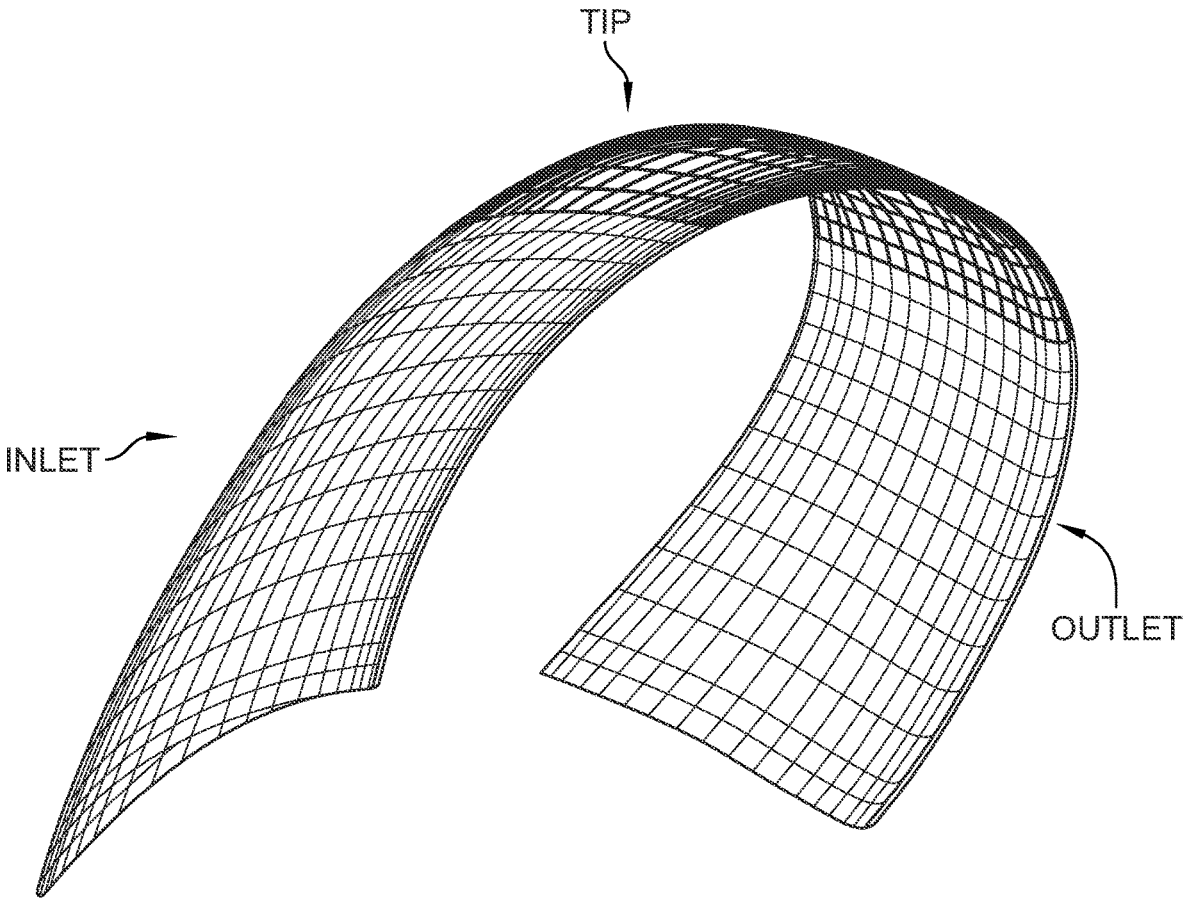

FIG. 25 depicts a schematic of the inlet, outlet and tip portions of a propeller.

DETAILED DESCRIPTION OF EMBODIMENTS

The figures and descriptions provided herein may have been simplified to illustrate aspects that are relevant for an understanding of the described devices, systems, and methods, described herein while eliminating, for the purpose of clarity, other aspects that may be found in typical devices, systems, and methods. Those of ordinary skill may recognize that other elements or operations may be desirable or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that could be implemented by those of ordinary skill in the art.

Figure 1:
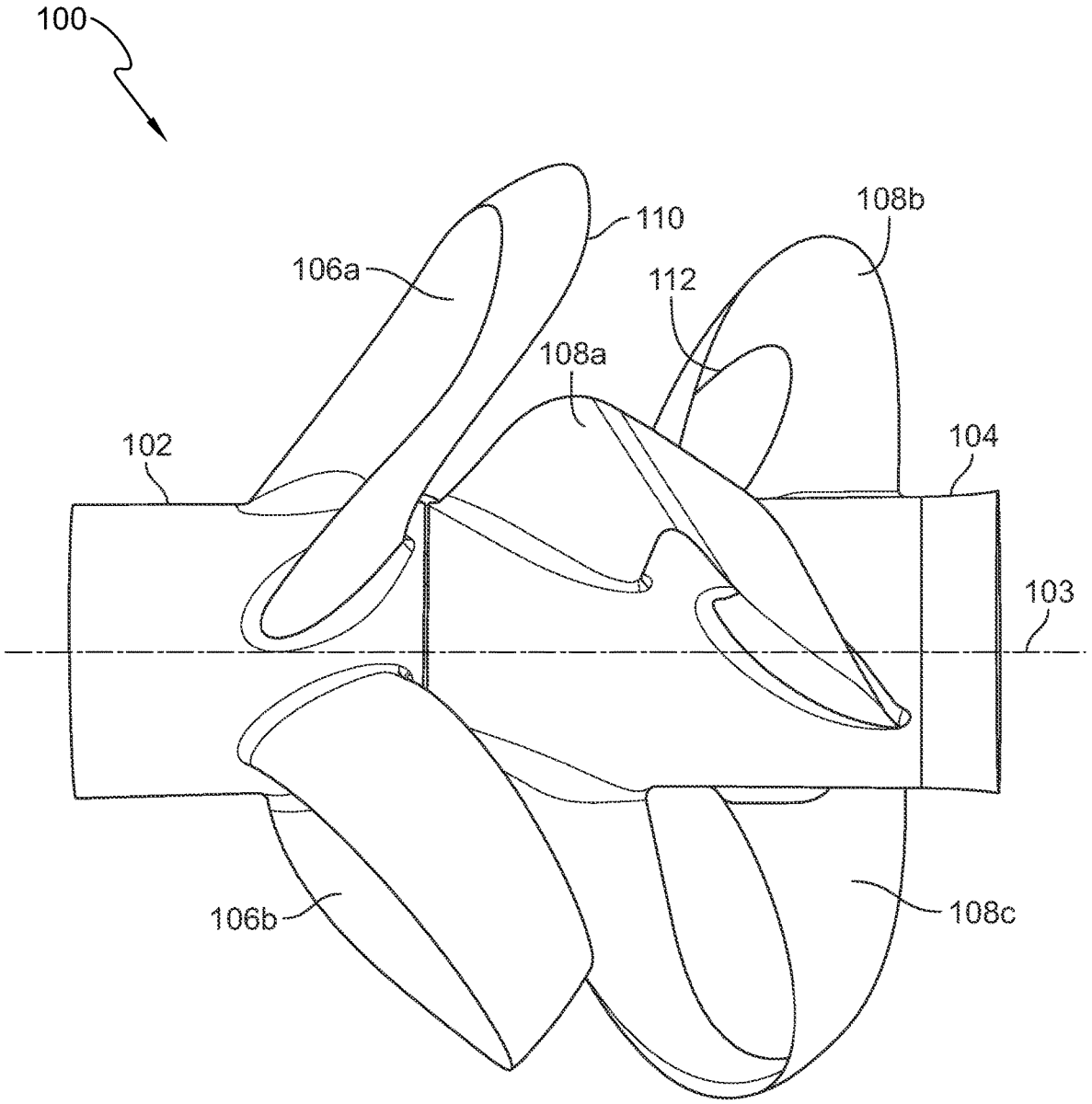
FIG. 1 depicts an illustrative CR propeller.

FIG. 1 depicts an illustrative CR propeller 100. The term "duo-propeller" may also be used in place of "CR propeller." Propeller 100 includes a forward propeller 102 and an aft propeller 104. Forward propeller 102 is coaxially aligned with aft propeller 104. Forward propeller 102 includes three blades 106*a*, 106*b*, 106*c* (the latter not shown in FIG. 1). Aft propeller 104 includes blades 108*a*, 108*b*, 108*c*. Blades 106*a,b,c* and 108*a,b,c* each form a loop. The CR propeller may include additional blades, such as four, five or six for example. Propeller 102 rotates in an opposite direction from propeller 104.

The term "propeller" as used herein may include rotary blade devices that can be used to displace fluid to propel an apparatus, or which are employed in a stationary device such as, for example, a cooling or other air circulating fan, which moves fluid such as air through or around it.

Figure 2:
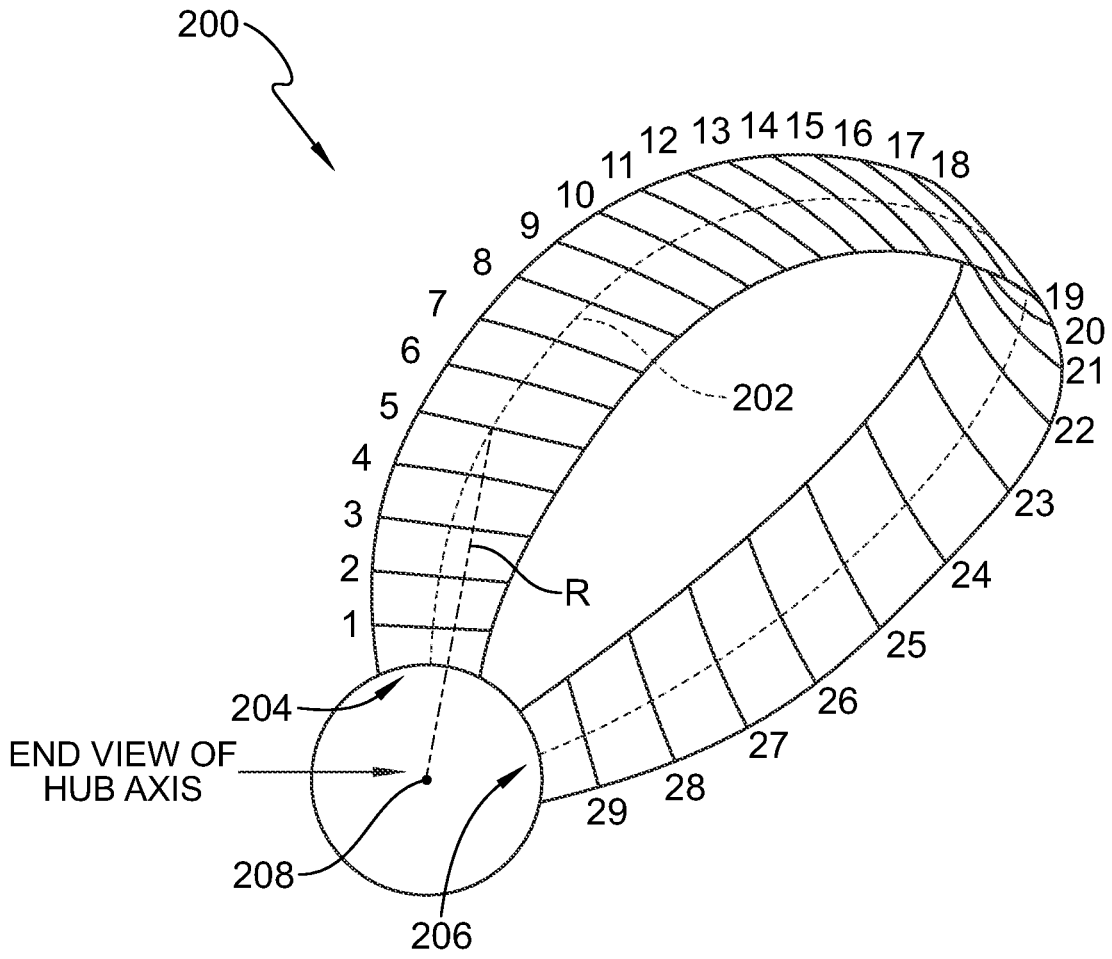
FIG. 2 depicts an illustrative blade having a plurality if parameter sections.

FIG. 2 depicts an illustrative blade 200 having parameter sections 1-29, with parameter section 1 in the vicinity of the intake root 204, and parameter section 29 in the vicinity of exhaust root 206. Each parameter section represents a set of physical properties or measurements whose values determine the characteristics of the blade. The parameter sections as a group determine the shape of blade 200 and its behavior. Parameter sections are equally spaced in an exemplary embodiment but may be selected at unequal intervals. FIG. 2 serves merely to illustrate how blade parameter sections may be laid out to define blade geometry that can be applied to any type of blade disclosed herein. Parameter sections represent the shape and orientation of blade 200 at a particular place along the blade. A smooth transition is formed between parameter sections to create a blade. As used herein "orientation" may include location. In the illustrative embodiment in FIG. 2, blade sections 1-29 are planar sections disposed along an irregular helical median line 202. "Irregular helix" is used herein to mean varying from a mathematical helix-defining formula or as a spiral in 3-D space wherein the angle between the tangent line at any point on the spiral and the propeller axis is not constant. The blade may have an irregular, non-helical median line at least in part, or the median line may be an irregular helix throughout.

Although 29 blade sections are shown in FIG. 2, more or fewer sections can be used to define a blade. Additionally, sections may exist within or partially within the hub that are not shown or fully shown. Blades may be defined by planar or cylindrical parameter sections.

Parameter sections 1-29 are defined, for example, by orientation variables, such as roll angle and vertical angle (alpha), and may include location variables; and shape variables, such as chord length, thickness, and camber. Additional illustrative orientation or location variable include rake, skew angle and radius. Some or more of the variables may change throughout the blade or a blade portion and some may be constant throughout. Orientation variables may be measured with respect to an X-Y-Z coordinate system. The X-Y-Z coordinate system has the origin at the shaft centerline and a generating line normal to the hub or shaft 210 or hub axis, such as hub axis 103 shown in FIG. 1. The X-Axis is along hub axis 103, positive downstream. The Y-Axis is up along the generating line and the Z-Axis is positive to port for a right handed propeller. A left-handed propeller is created by switching the Z-Axis and making a left hand coordinate system.

Parameter sections may be located by their chord (nose-to-tail) midpoint, such as by using radius, rake and skew. Parameter sections may be oriented using the angles phi (skew), psi (roll) and alpha (pitch), as will be described further below.

FIG. 25 is a schematic of a propeller blade to illustrate the inlet portion, tip portion and outlet portion of a propeller blade. The tip portion is the darker area connecting the inlet portion to the outlet portion. This illustration can be applied to any of the blades disclosed herein. In an illustrative embodiment of a propeller, the inlet portion extends from an inlet root to where the blade reference line is 88% of the blade outer radius and increasing. The outlet portion extends from where the blade reference line is 88% of the blade outer radius and decreasing to the outlet root. The tip is the portion between the inlet portion and the outlet portion. The blade reference line is the curve connecting all the parameter section mid-chord points. In a further illustrative embodiment, each of the inlet portion and the outlet portion extend from their respective root to where the blade reference line is in the range of 75% to 100% of the blade outer radius and increasing. The tip portion in the remaining portion between the inlet and outlet portions.

Figure 3:
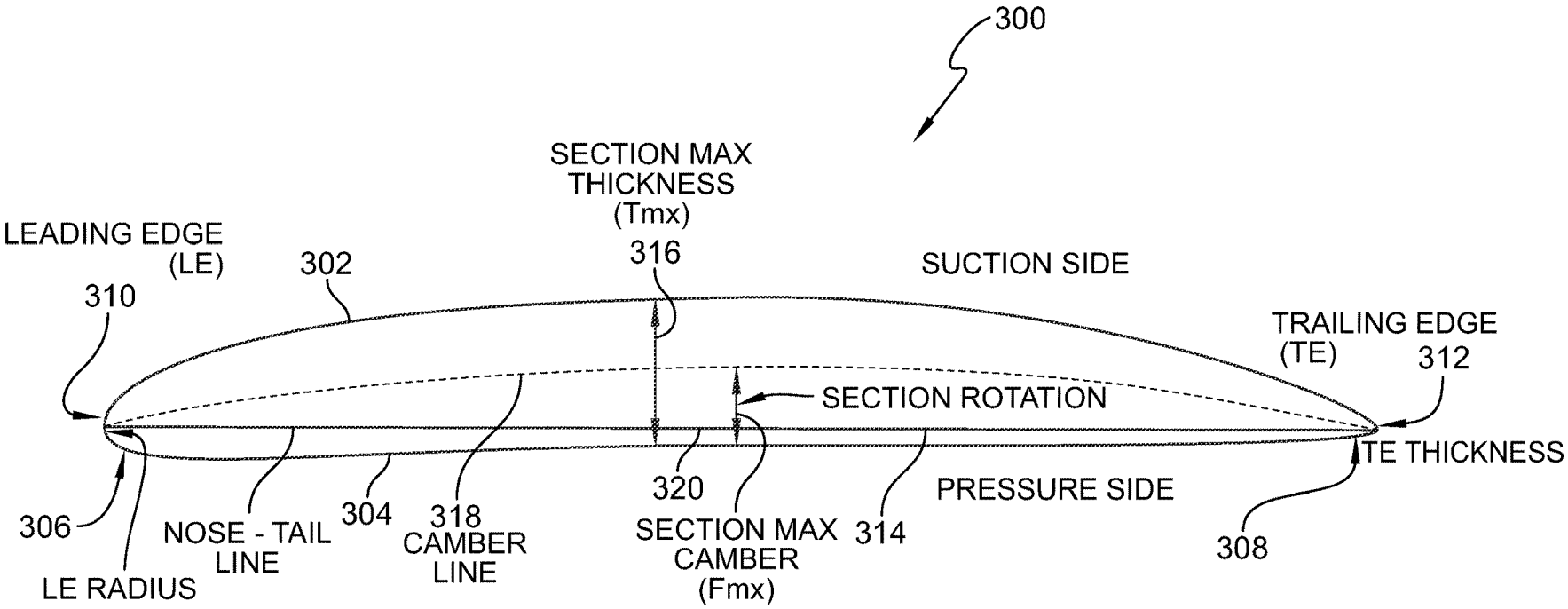
FIG. 3 depicts an illustrative blade parameter section geometry by reference to a cross-sectional profile of a blade.

FIG. 3 depicts an illustrative blade parameter section geometry by reference to a cross-sectional profile of a blade. The illustration is merely to provide definitions and can be applied to any of the blade or propeller embodiments described herein. An illustrative parameter section is in the form of an asymmetrical airfoil. The airfoil is bounded by a curved blade surface line 302 and a generally flat blade surface line 304, with a rounded nose 306 at the leading edge 310 of the parameter section and a pointed or less rounded tail 308 at the trailing edge 312 of parameter section 300. Parameter sections may also be in the shape of a symmetrical airfoil. Additional parameter section shapes include, for example, a shape having parallel blade surface lines 302, 304. Blade surface lines 302, 304 may also be linear and at an angle to one another. The nose and tail edges may both be rounded, both be flat (perpendicular to one or both blade surface lines 302, 304) or one of either the nose or tail may be rounded and the other of the two flat. A blade formed of a sheet material, for example, would generally exhibit parallel blade surface lines 302, 304. In an illustrative example of a blade formed of a sheet, the leading edge of the blade is rounded and the trailing edge is flat or less rounded, though both intake and trailing edges could be rounded.

Illustrative shape variables for parameter sections are defined as follows;

Radius: The term radius is used to define both the shape of a parameter section and its orientation with respect to the X-Y-Z coordinate system. With regard to the parameter section shape, radius may refer to the curvature of the nose 306 of parameter section 300, for example, and thus will be referred to as a "nose radius." Other points on parameter section 300 may be used to calculate a radius. By way of example, parameter section leading edge radius may be calculated based on maximum thickness 316 and the length of chord 314. It is also noted that the term radius when used with respect to propellers is the perpendicular measure from the hub radius to the outer most point of the propeller blades.

Chord: The chord is the nose-to-tail line 314 of the parameter section.

Thickness: Various thickness measurements may define a parameter section such as, for example, the maximum thickness 316. A further illustrative example is the trailing edge thickness, which may be calculated as a percentage of maximum thickness 316. For example, the trailing edge thickness may be 6%-10% of maximum thickness 316 of parameter section 300.

Camber: Camber 318 defines the curvature of a parameter section.

Illustrative orientation variables include:

Rake: Rake is the axial location of a parameter section chord midpoint. By "axial location" it is meant in this instance, along the X-axis, which is coincident with the propeller rotational axis.

Pitch Angle: Pitch Angle is the angle between the chord line of a parameter section and a plane perpendicular to the X-axis. Pitch angle may be calculated based on pitch distance and blade radius. Examples of pitch angle of parameter sections is provided in FIGS. 7A-7C.

Roll: The roll angle (psi) is the orientation angle about chord 314, for example.

Radius: The orientation radius is the distance from the hub center 208 to the midpoint 320 of chord 314 of a parameter section. Chord 314 may also be referred to as the nose-to-tail line. The radius described in this paragraph will be referred to as the parameter section orientation radius to differentiate it from the nose radius or other parameter section shape radii, which are not measured with respect to the X-Y-Z coordinate system. Midpoint 320 of chord 314 is the point on the parameter section chord line through which the median line 202 would pass. This is illustrated in FIG. 2 by line R which extends from hub center 208 to the midpoint of the chord of parameter section 5. Note that the chord of parameter section 5 and its midpoint are not specifically shown in FIG. 2.

Illustrative rake measurements are shown in FIGS. 4A-F for various parameter sections. FIGS. 4A-F generally describe various parameters of a propeller blade and can be applied to any of the blade or propeller embodiments described herein. Each of FIGS. 4A-F show coordinates X, Y and Z, wherein the X-axis is coincident with the propeller rotational axis, and the Y-axis and Z-axis are perpendicular to the X-axis, and the three axes are mutually perpendicular. Parameters are measured from the origin of the coordinate system. In an illustrative embodiment, the zero point of the coordinate system is along the propeller rotational axis, and is closer to the intake root than the exhaust root. Illustratively, values along the X-axis toward the intake root are negative and toward the exhaust root are positive. In general, a coordinate system can be located as desired and all parameters or geometry are measured from the origin of the selected coordinate system.

Figure 4A:
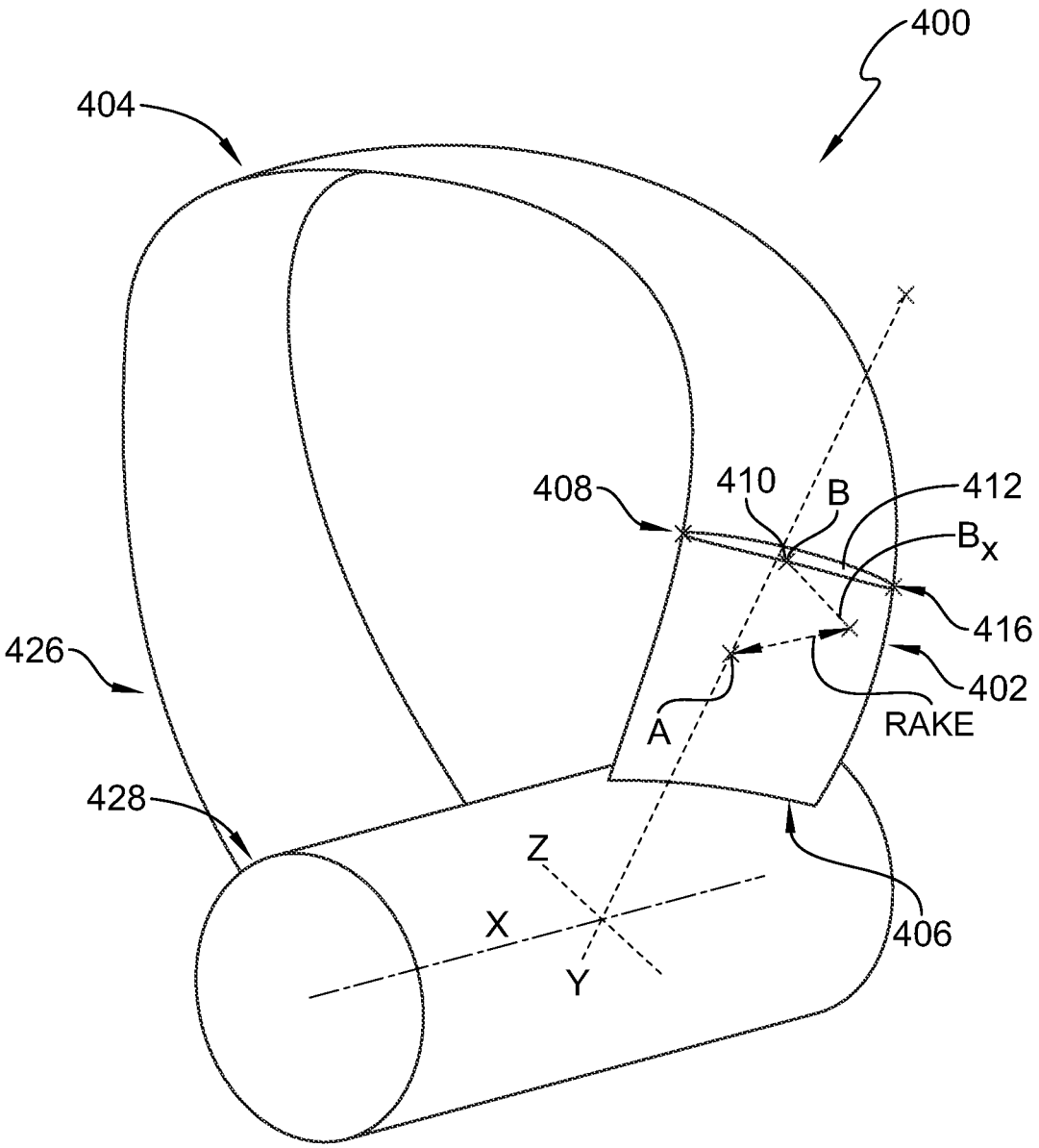
Figure 4B:
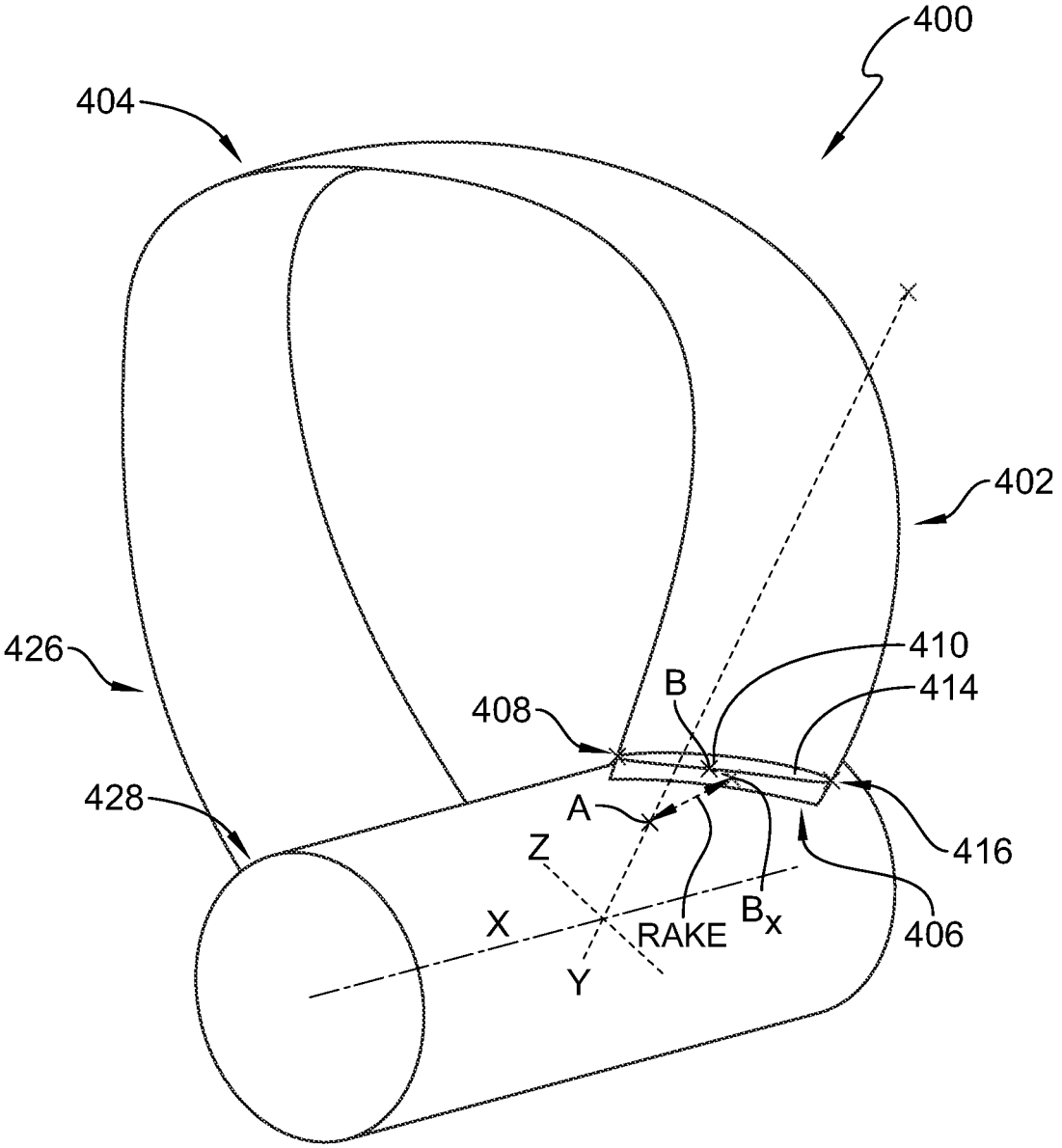

FIGS. 4A and 4B depict rake for parameter sections 412, 414 on the intake portion 402 of blade 400. Parameter section 412 in FIG. 4A is toward tip portion 404 of blade 400. Parameter section 414 in FIG. 4B is toward intake root 406. Rake is measured along the propeller rotational axis or along a line parallel to the rotational axis. In the illustrative examples of FIGS. 4A, 4B, rake is the distance from point A at X equals zero to the X coordinate value of point B, wherein point B is at the midpoint 410 of the chord of parameter sections 412, 414. The X-coordinate value of point B is represented by Bx in FIGS. 4A-F. Chords of parameter sections shown in FIGS. 4A-F are defined by end points 408, 416.

Figure 4C:
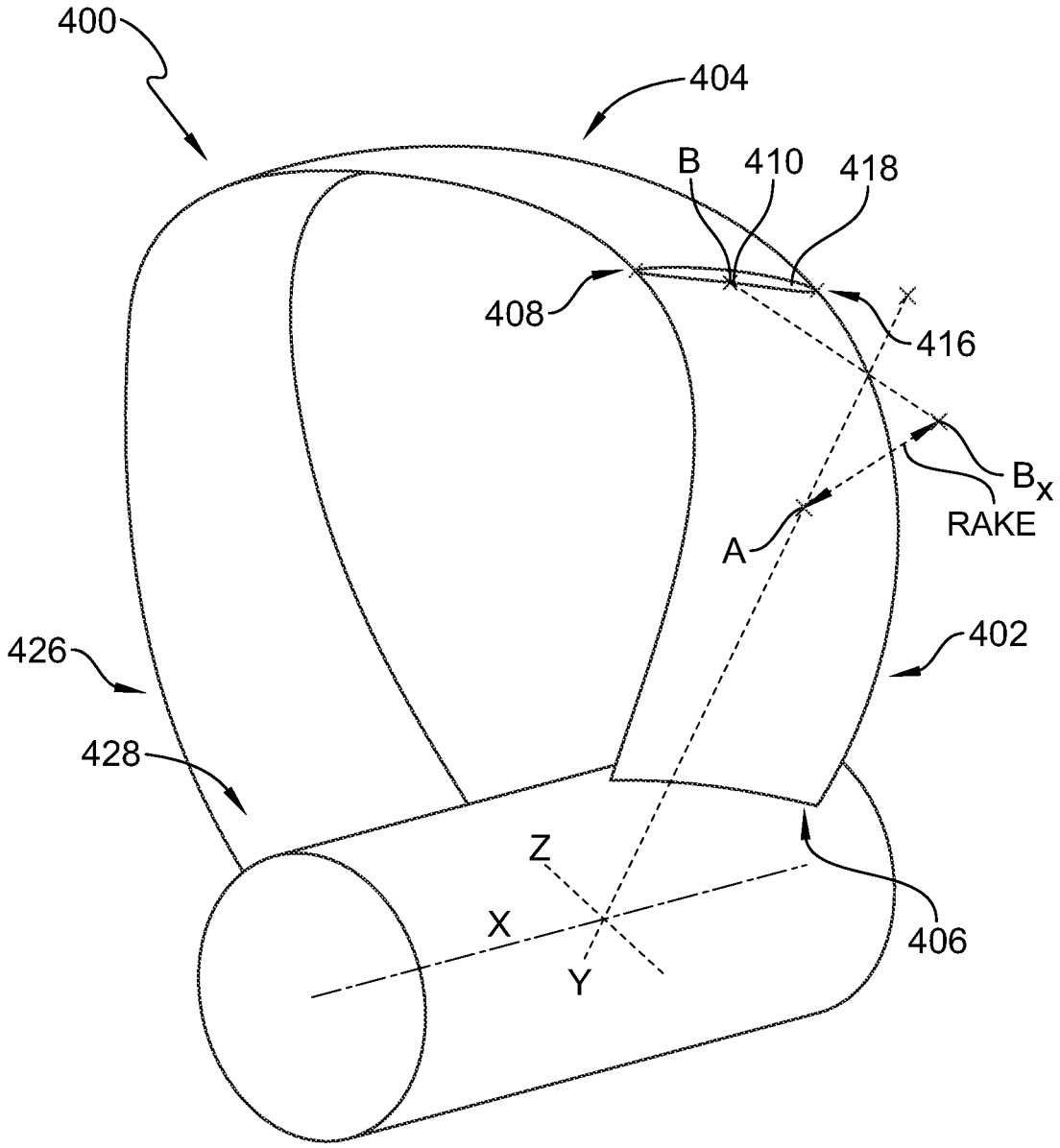
Figure 4D:
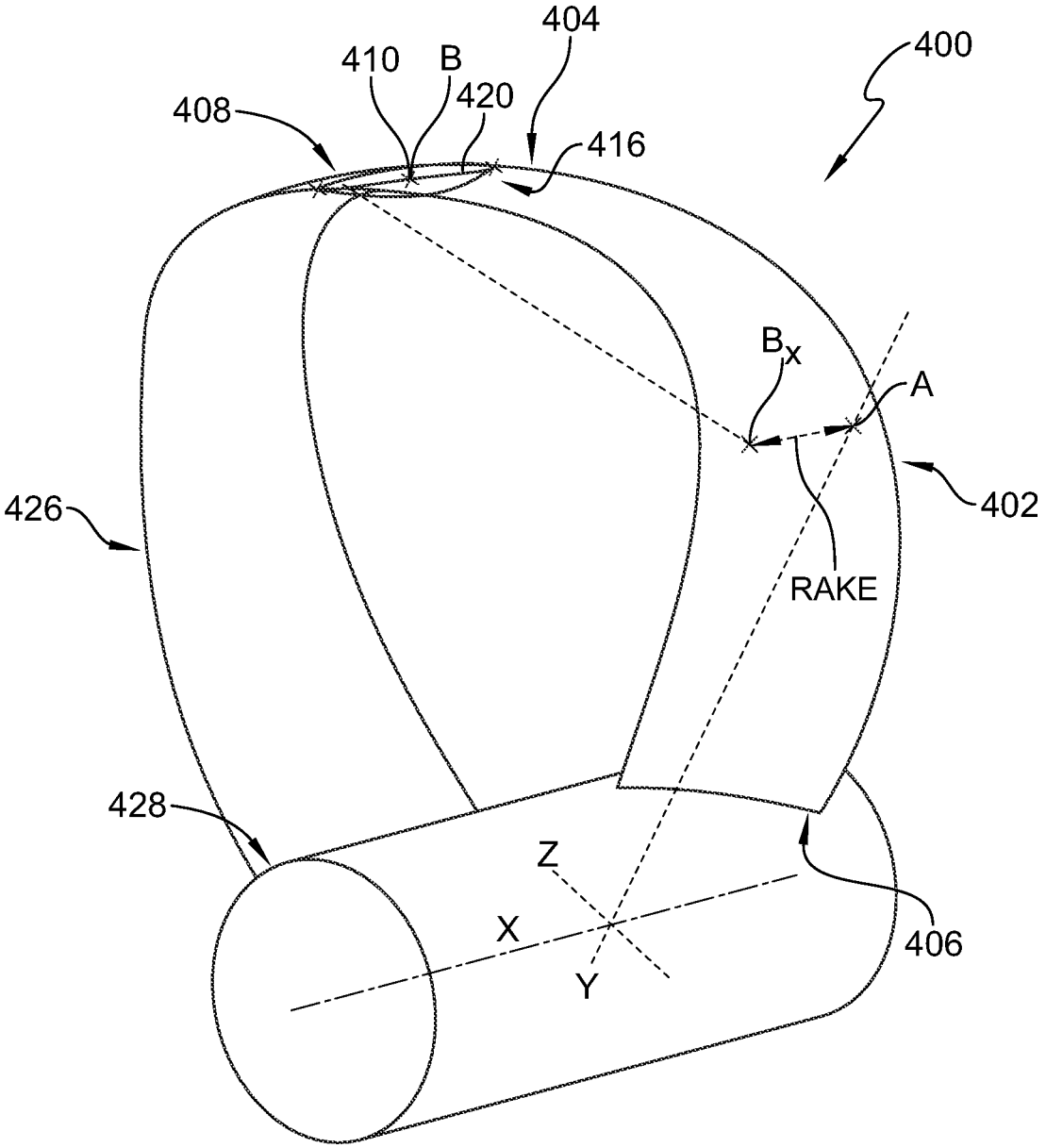
Figure 4E:
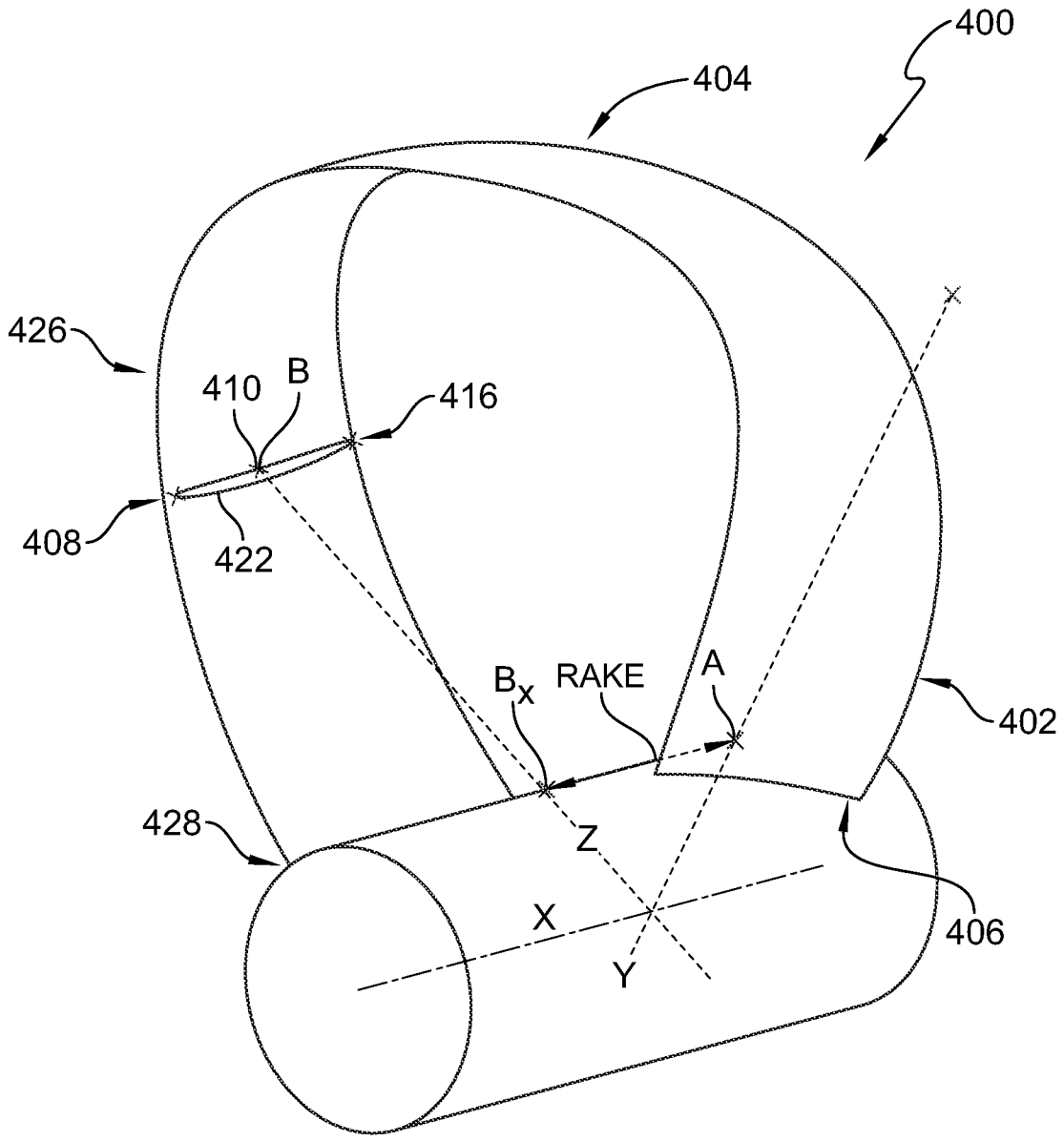
Figure 4F:
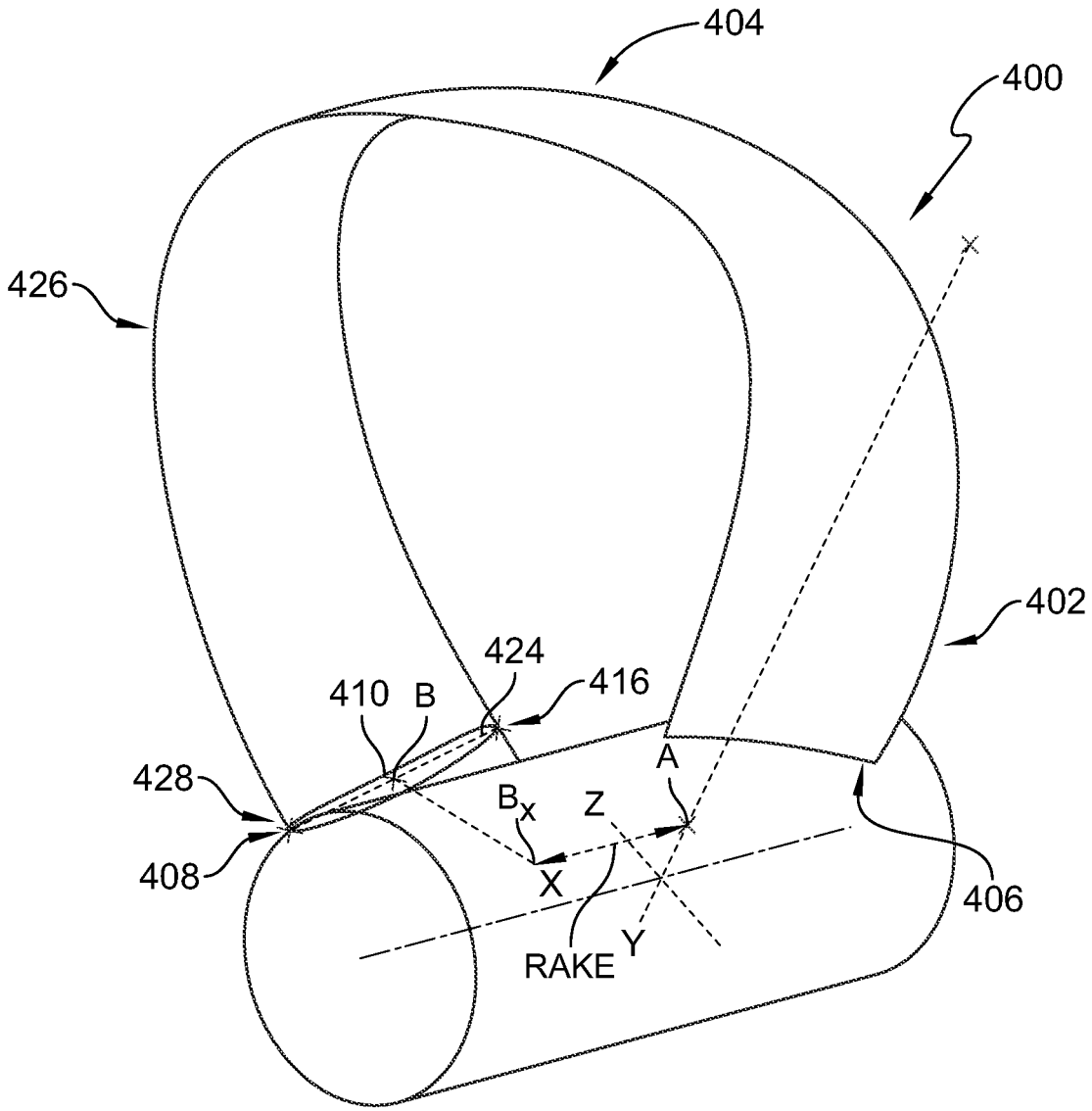

FIGS. 4C and 4D depict rake for parameter sections 418, 420 on the tip portion 404 of blade 400. Parameter section 418 in FIG. 4C is at a first position in tip portion 404 of blade 400 wherein the roll value (described further below) is greater than zero and less than 90 degrees. Parameter section 420 in FIG. 4D is at a second position in tip portion 404 where the roll value is equal to or greater than 90 degrees. In the illustrative examples of FIGS. 4C, 4D, Rake is the distance from point A at X equals zero to the X coordinate value, B.sub.x, of point B, wherein point B is at the midpoint 410 of the chord of parameter sections 418, 420. FIGS. 4E and 4F depict Rake for parameter sections 422, 424 on the exhaust portion 426 of blade 400. Parameter section 422 in FIG. 4E is toward tip portion 404 of blade 400. Parameter section 424 is toward exhaust root 428. In the illustrative examples of FIGS. 4E, 4F, Rake is the distance from point A at X equals zero to the X coordinate value of point B, wherein point B is at the midpoint 410 of the chord of parameter sections 422, 424.

FIGS. 23 and 24 schematically describe rake angle, which is difference than the linear rake measurements described above. Rake is the axial sweep of the blade in the direction of the axis of rotation 103. Rake value increases as the angle between the blade axis of rotation 103 and the median rake line of the blade decreases. In practice, the actual rake line is typically a non-linear curve. Rake is the determining factor in the axial blade-to-blade separation.

As shown in FIG. 23, a negative rake would be a forward angle relative to the blade root position, and a positive rake would be an aft-wards angle relative to the blade root position.

The disclosed novel propeller has blades with unique rake values for the inlet and outlet sections, which are independently configured. The dot-dash lines shown in FIGS. 23 and 24 indicate there exists a "collective rake" for any given design. A propeller can be described as lower rake (FIG. 23) and higher rake (FIG. 24).

Rake angle can be calculated by:

Rake Angle=ArcTangent (Total Rake/Radial Distance from Hub to Tip)

wherein

Radial Distance from Hub to Tip=(Prop Diameter−Hub Diameter)/2 and wherein

Displacements are relative to zero rake. In an illustrative process, the starting point is zero rake for a blade section at or just inside the inlet root. This makes the outlet root rake very high. The average of the rake at the roots is then calculated.

In a further illustrative embodiment, rake is calculated by:

Rake Angle=ArcTangent((Total Rake Tip−Total Rake Average of Roots)/Radial Distance from Hub to Tip)

A blade section or parameter section is the airfoil section at each spanwise station that is used to build up the blade, not a section cut of a 3D blade. In an illustrative embodiment the sections are based on standard sections developed by National Advisory Committee for Aeronautics (NACA), National Aeronautics and Space Administration's (NASA's) predecessor. The standard sections are then scaled to get the absolute Thickness and Camber we want at each station.

The geometry (particularly rake and skew) could be defined from either root. In an illustrative embodiment, the geometry is defined from the inlet. Traditionally, propeller geometry is based on (or near) the root and rake is determined from this point and the rake Angle is determined from this point. To the contrary, for embodiments of the propellers disclosed herein, the geometry is based on (or near) the inlet root and the rake angle is determined from the average of the inlet root and/or the outlet root.

Figure 5A:
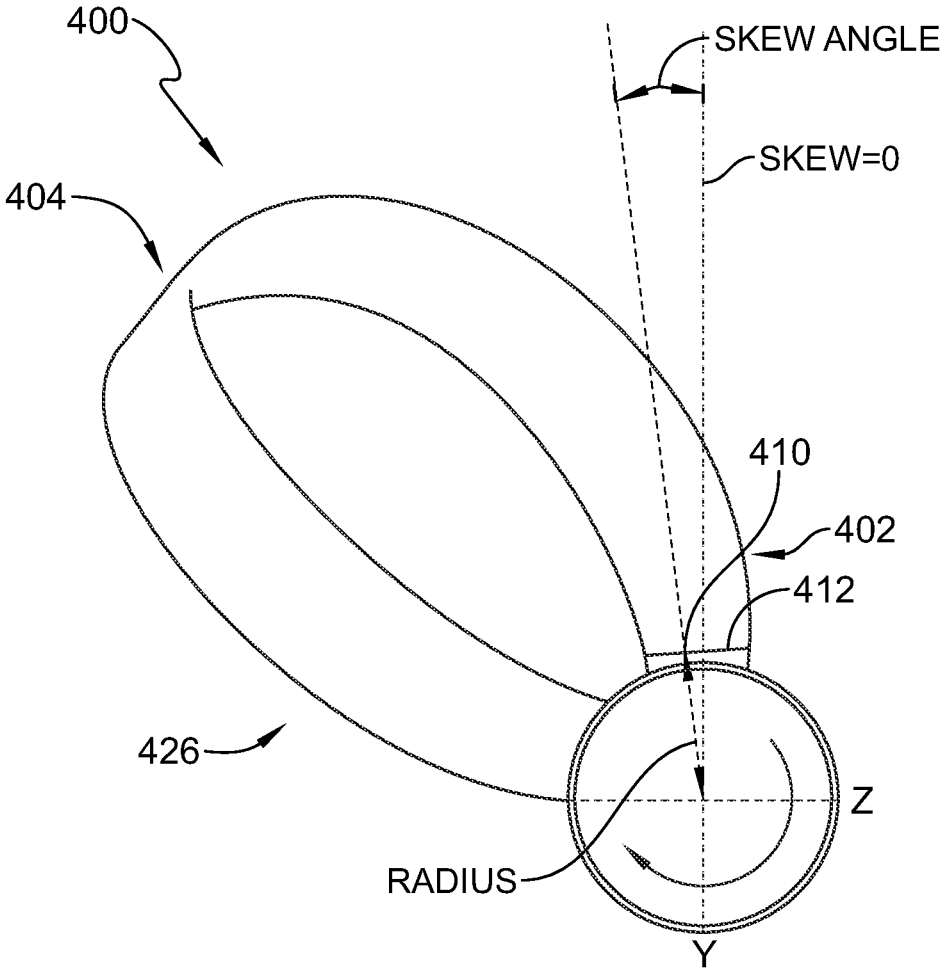
Figure 5B:
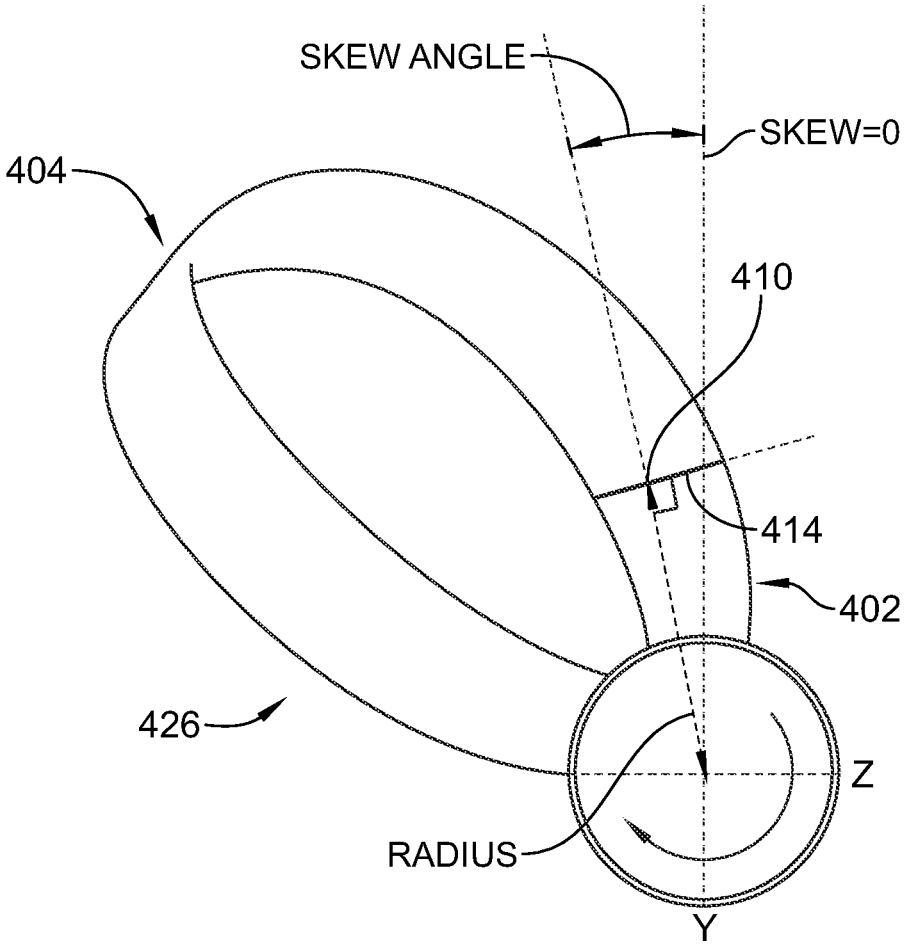
Figure 5C:
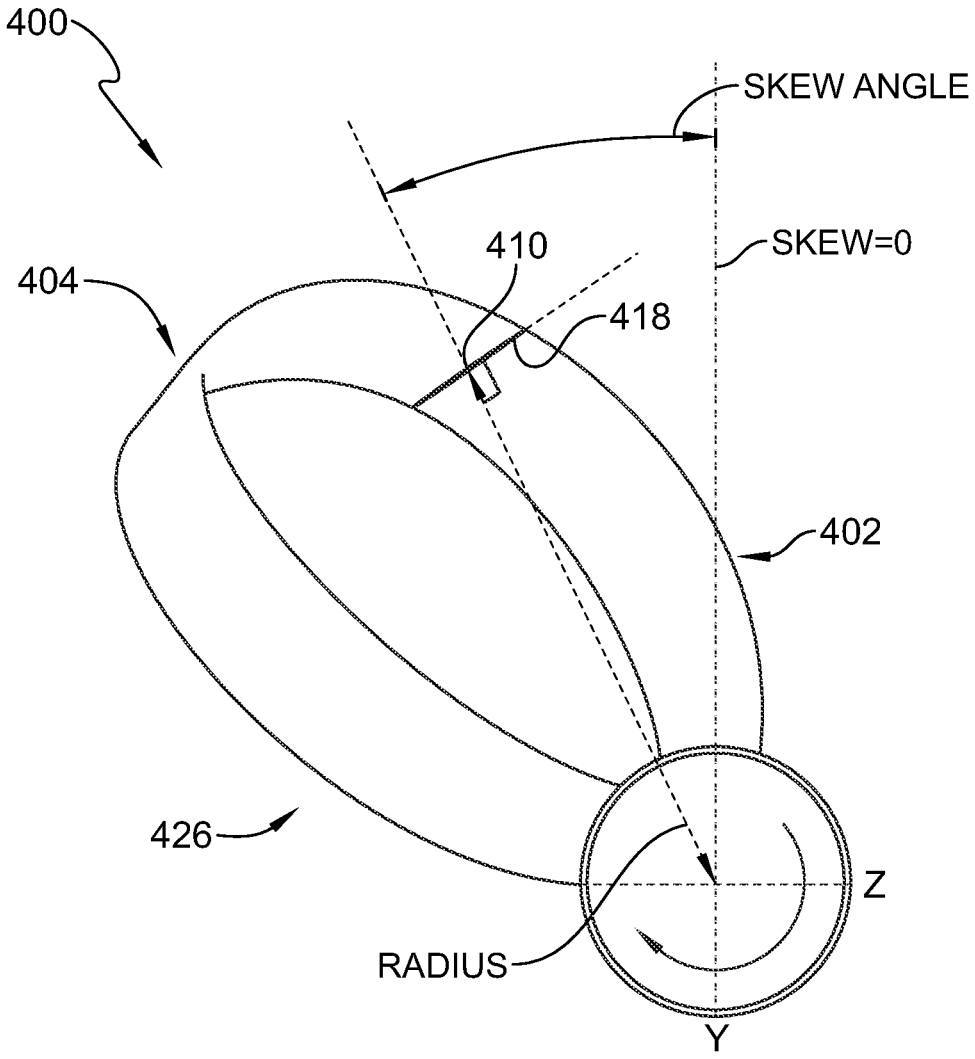
Figure 5D:
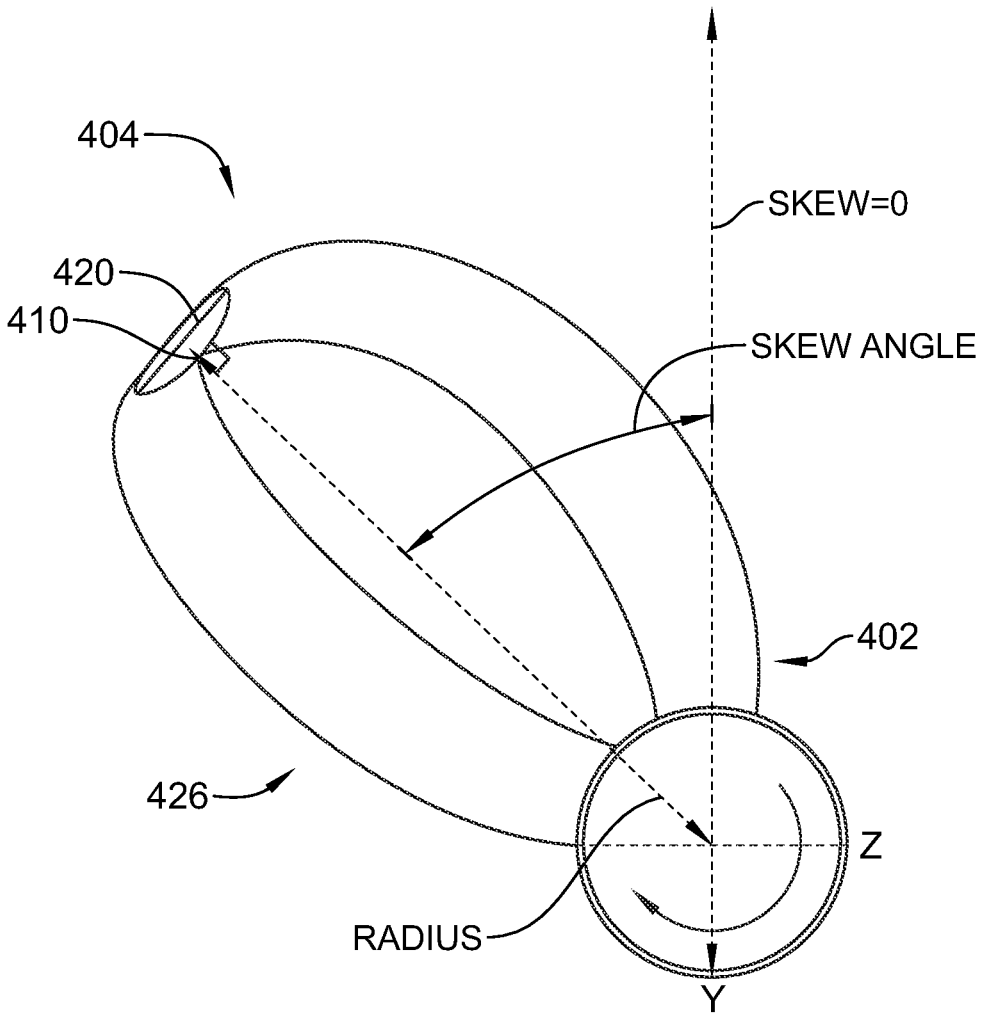
Figure 5E:
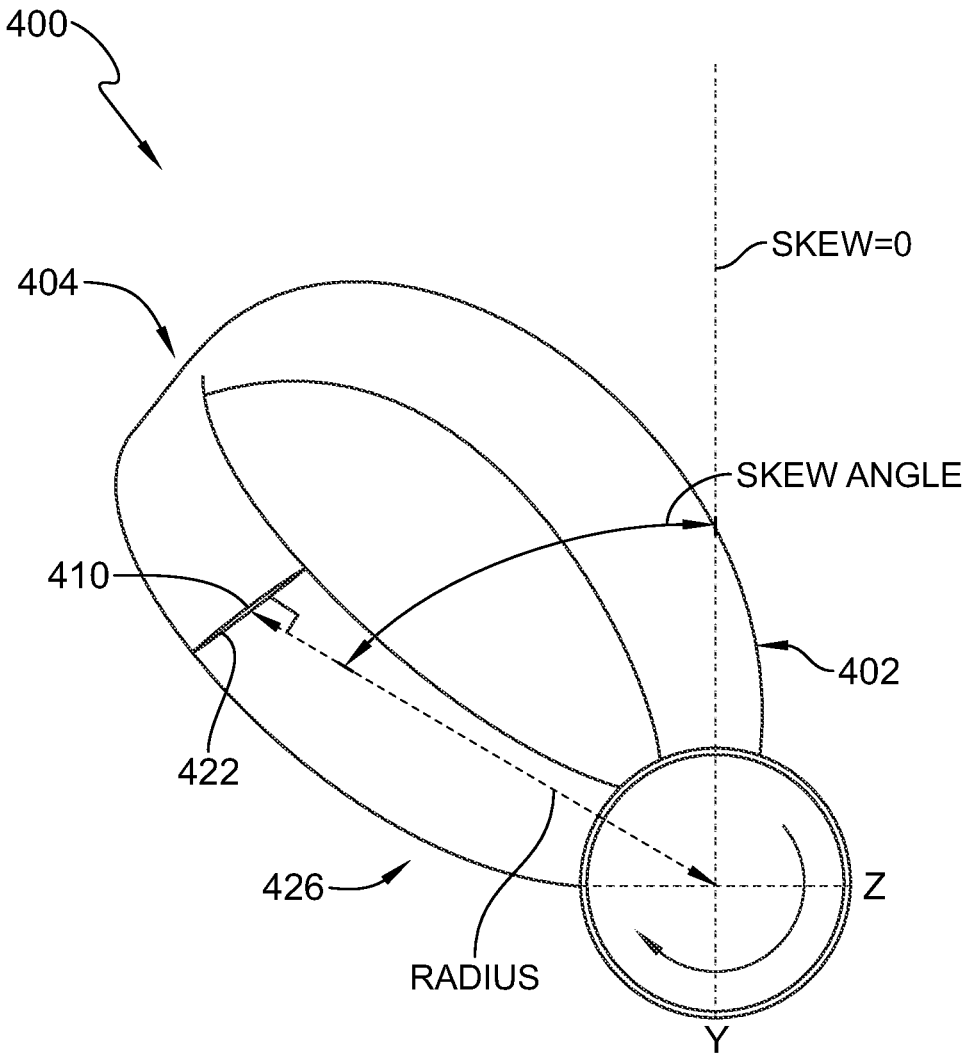
Figure 5F:
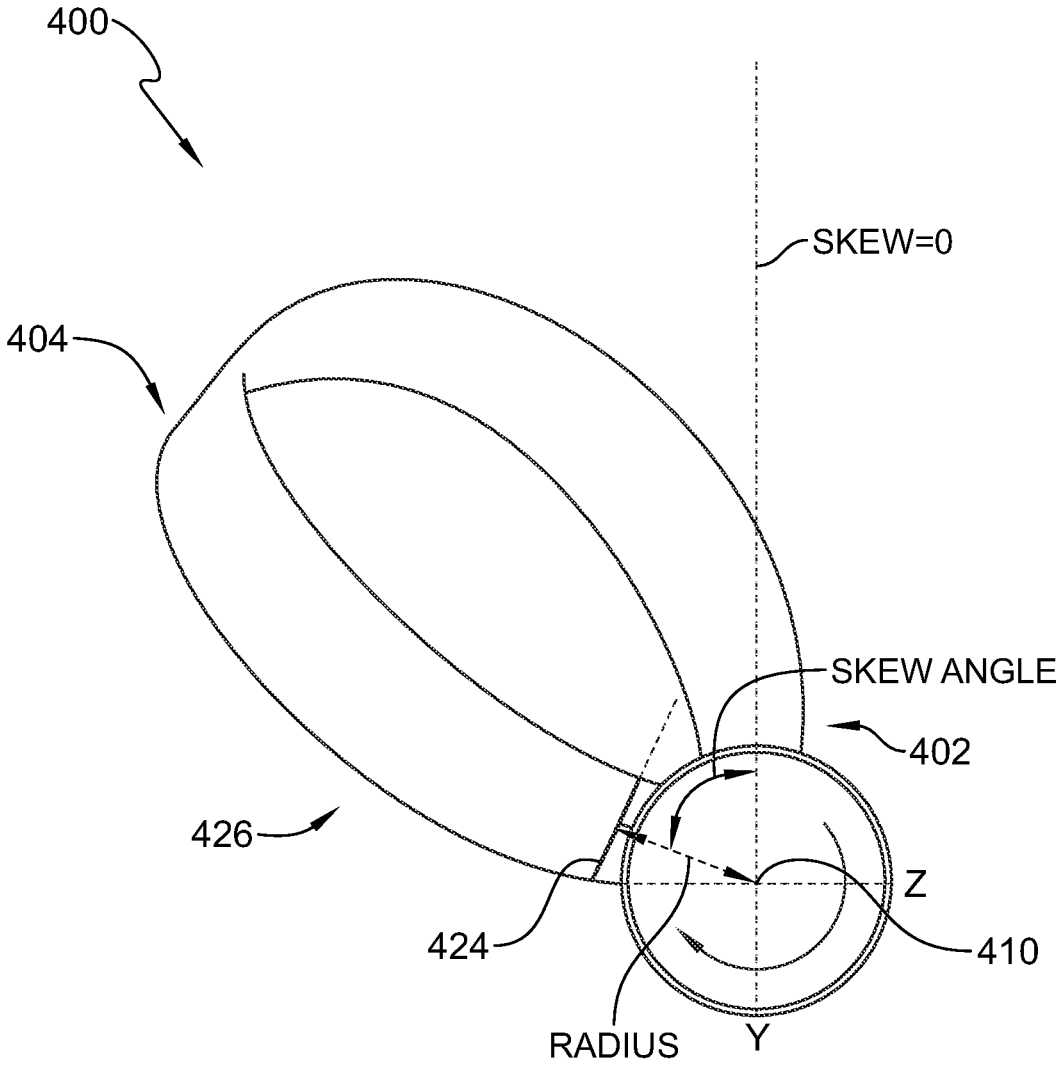
Figure 6A:
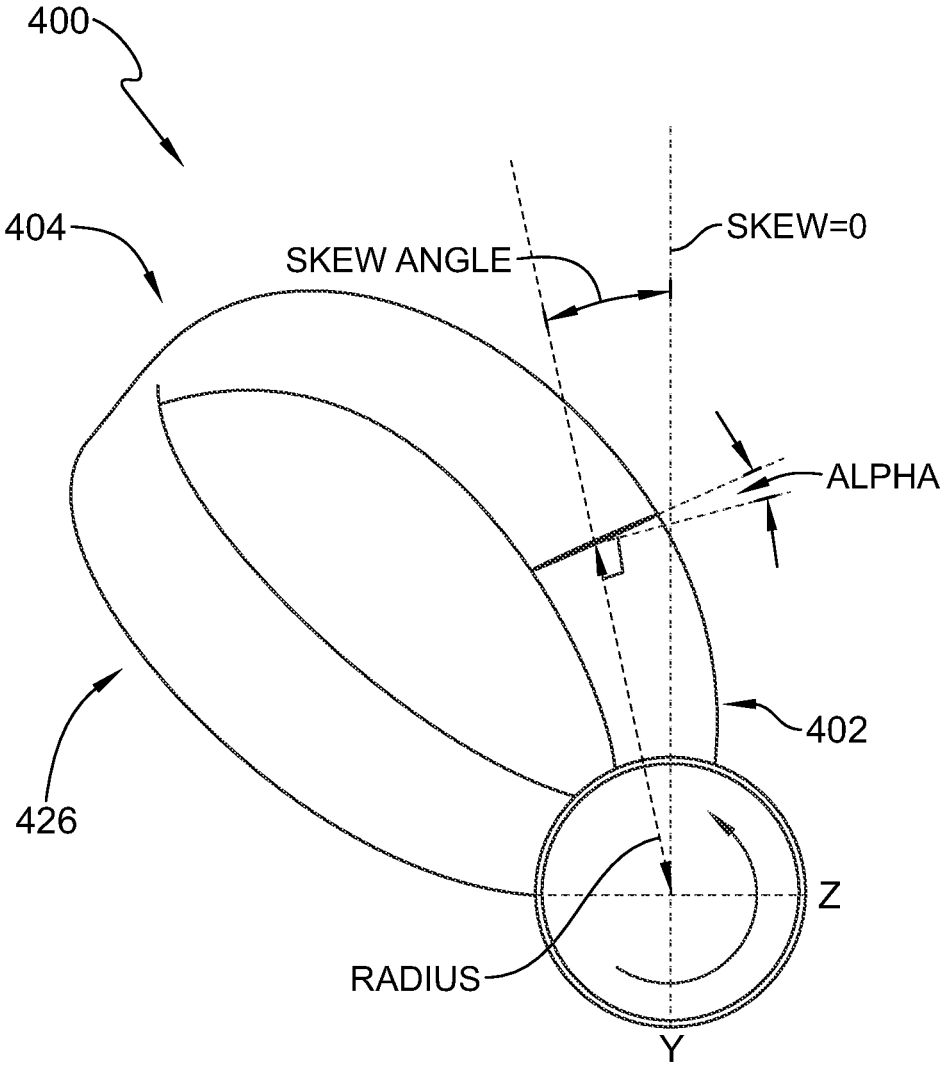
Figure 6B:
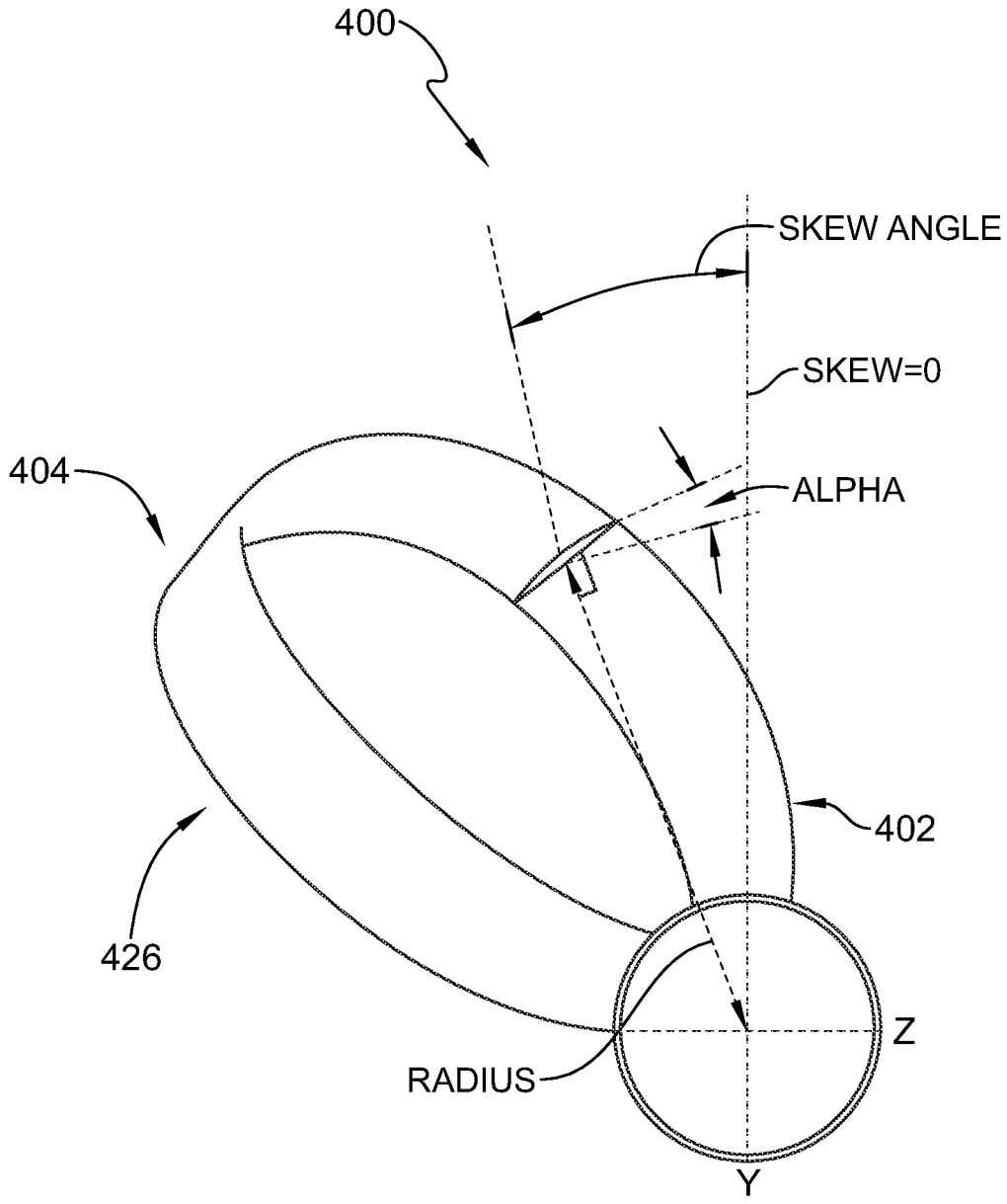
Figure 6C:
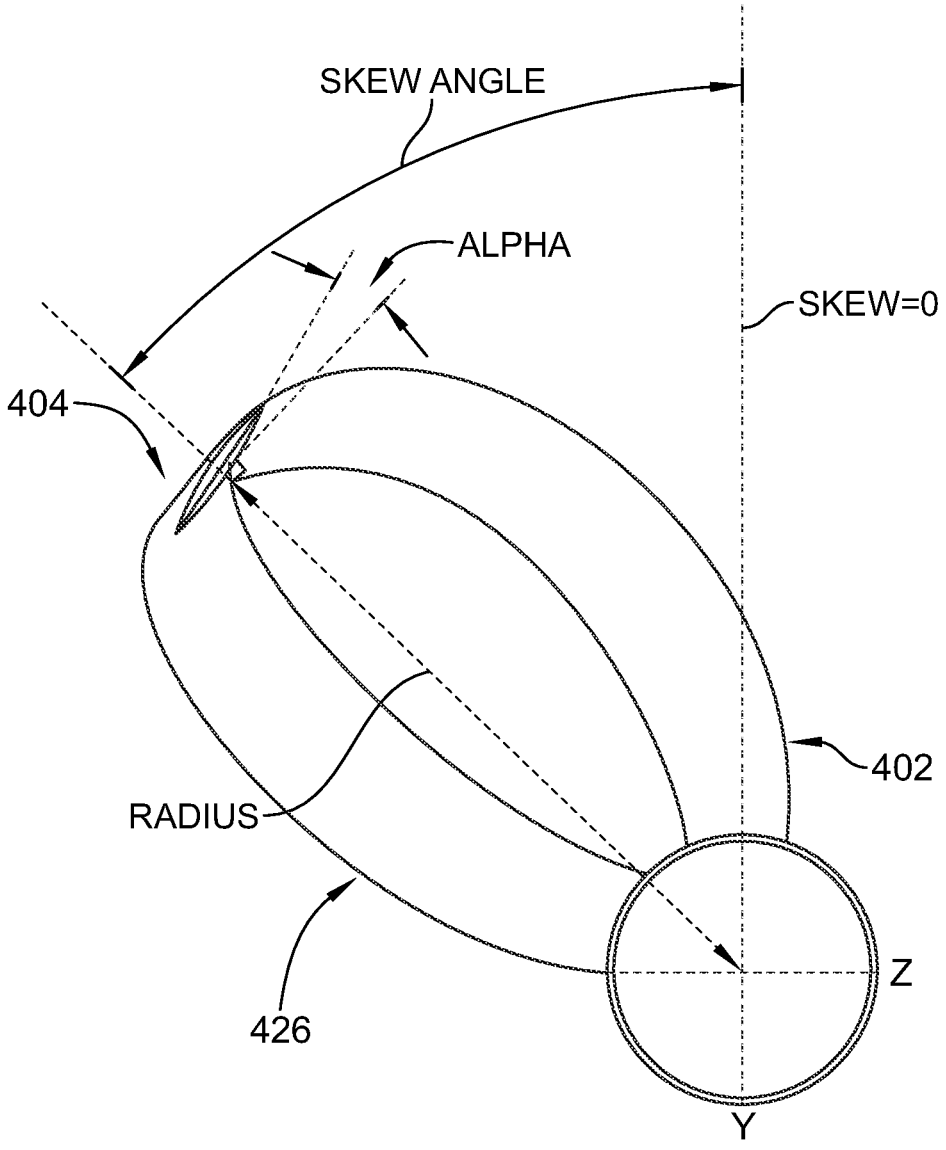
Figure 6D:
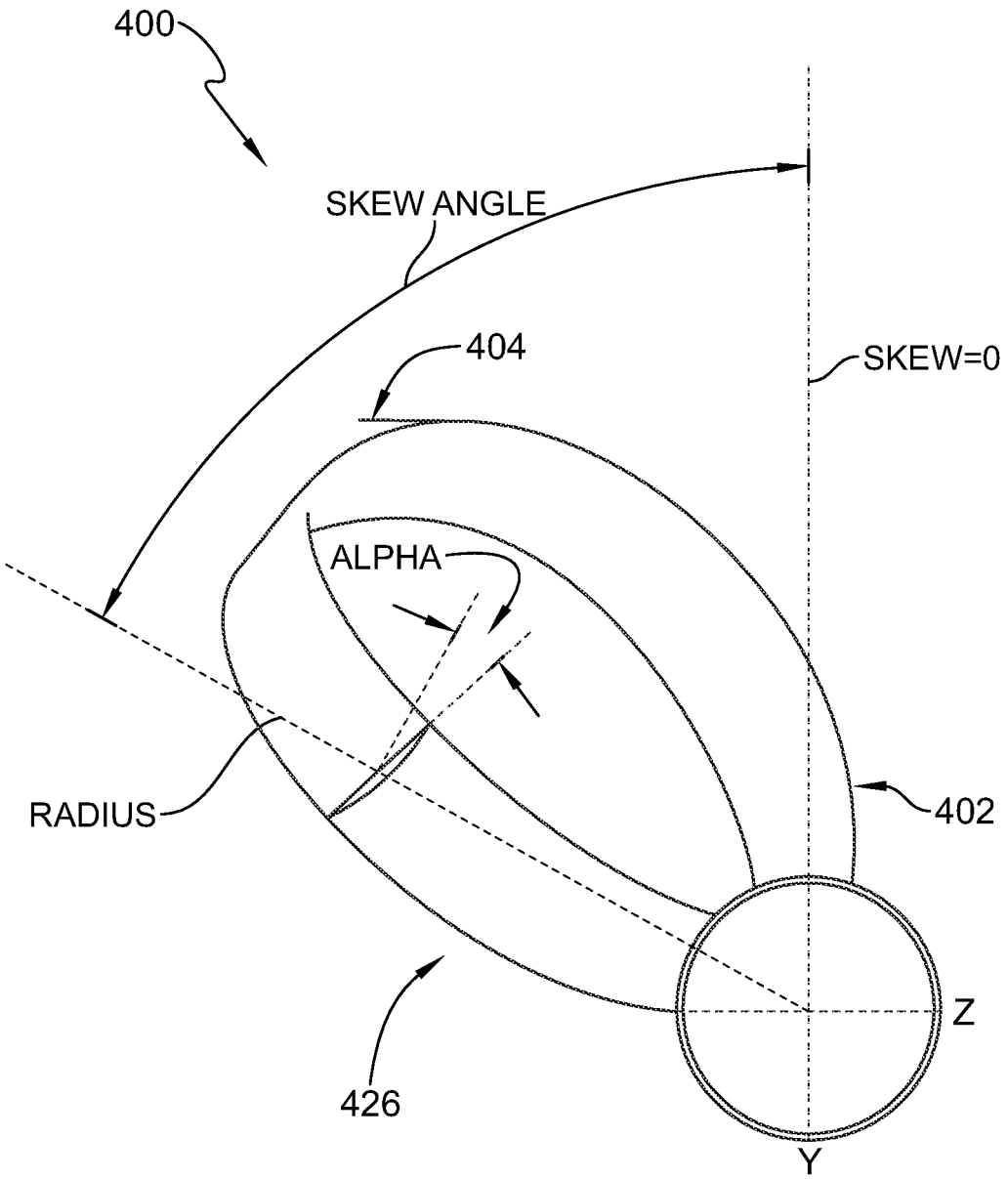
Figure 7A:
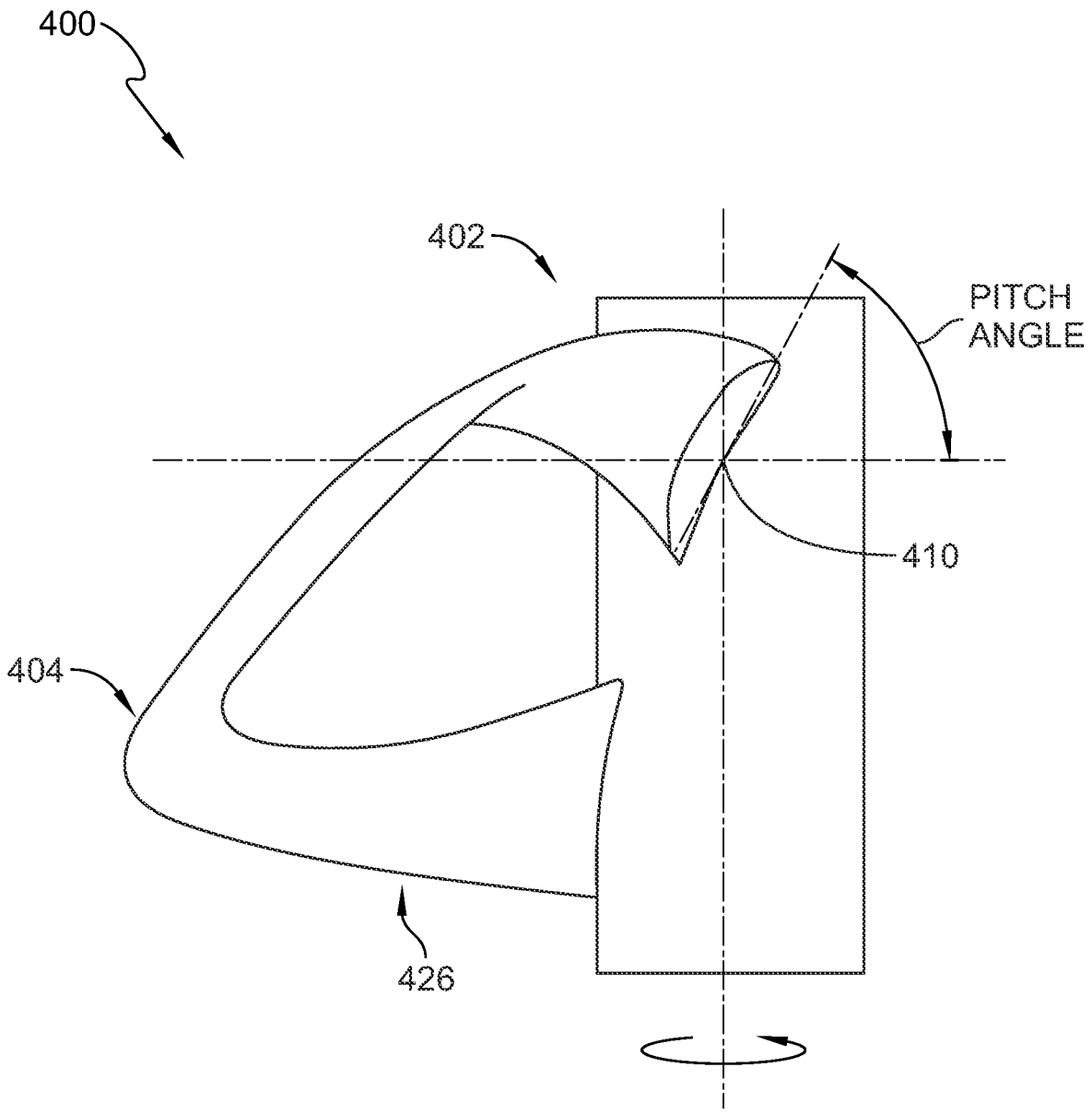
Figure 7B:
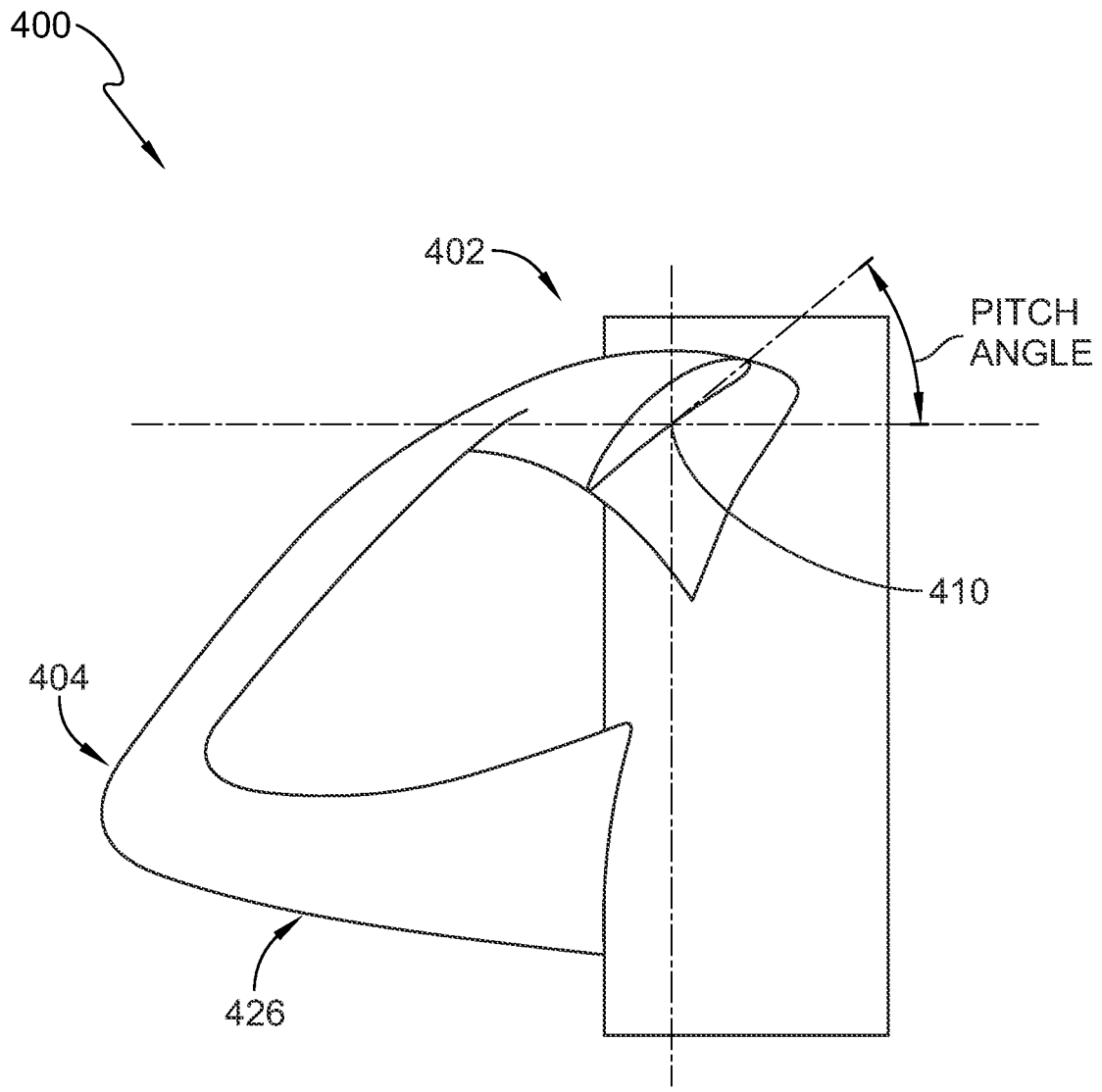
Figure 7C:
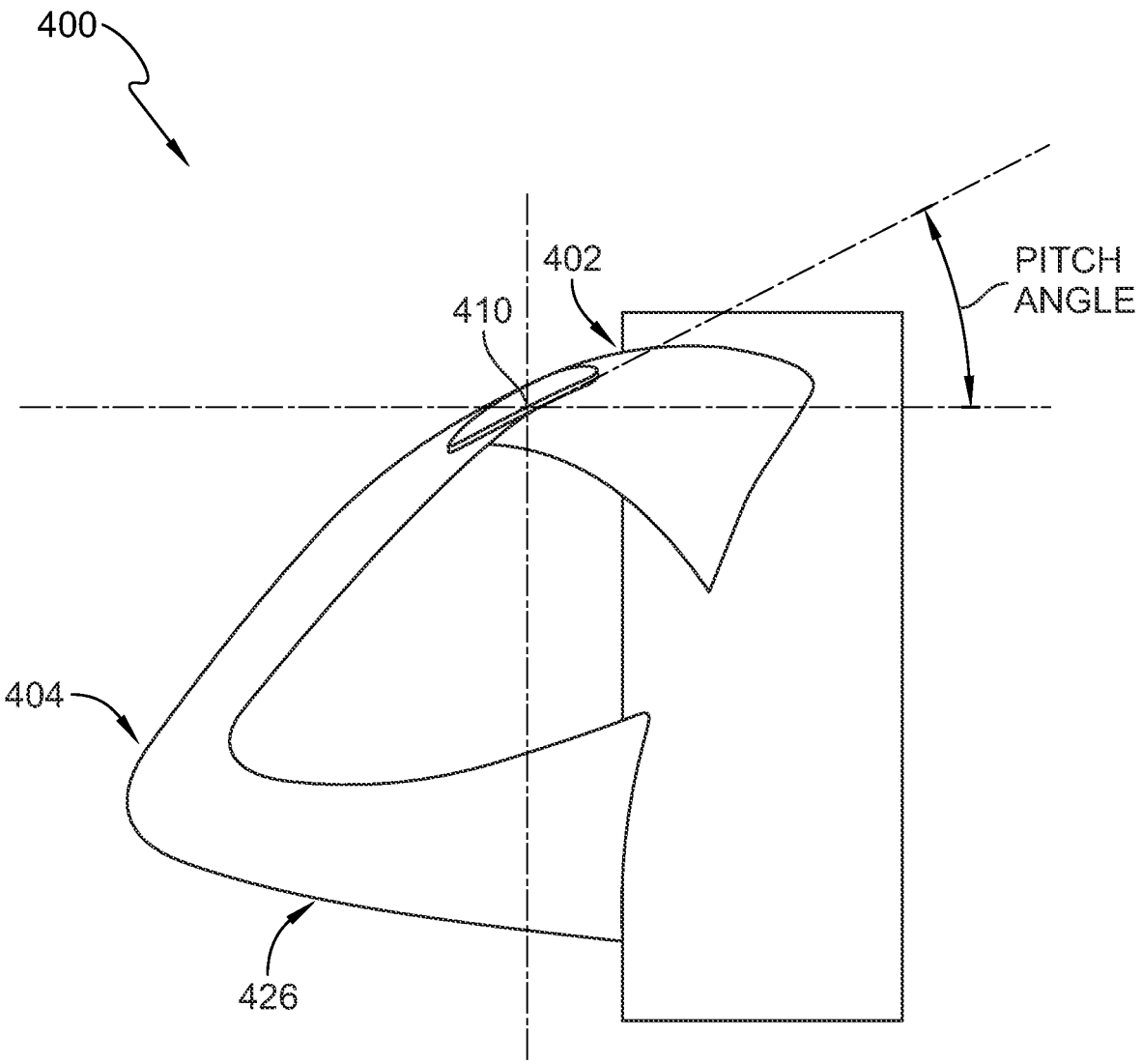
Figure 7D:
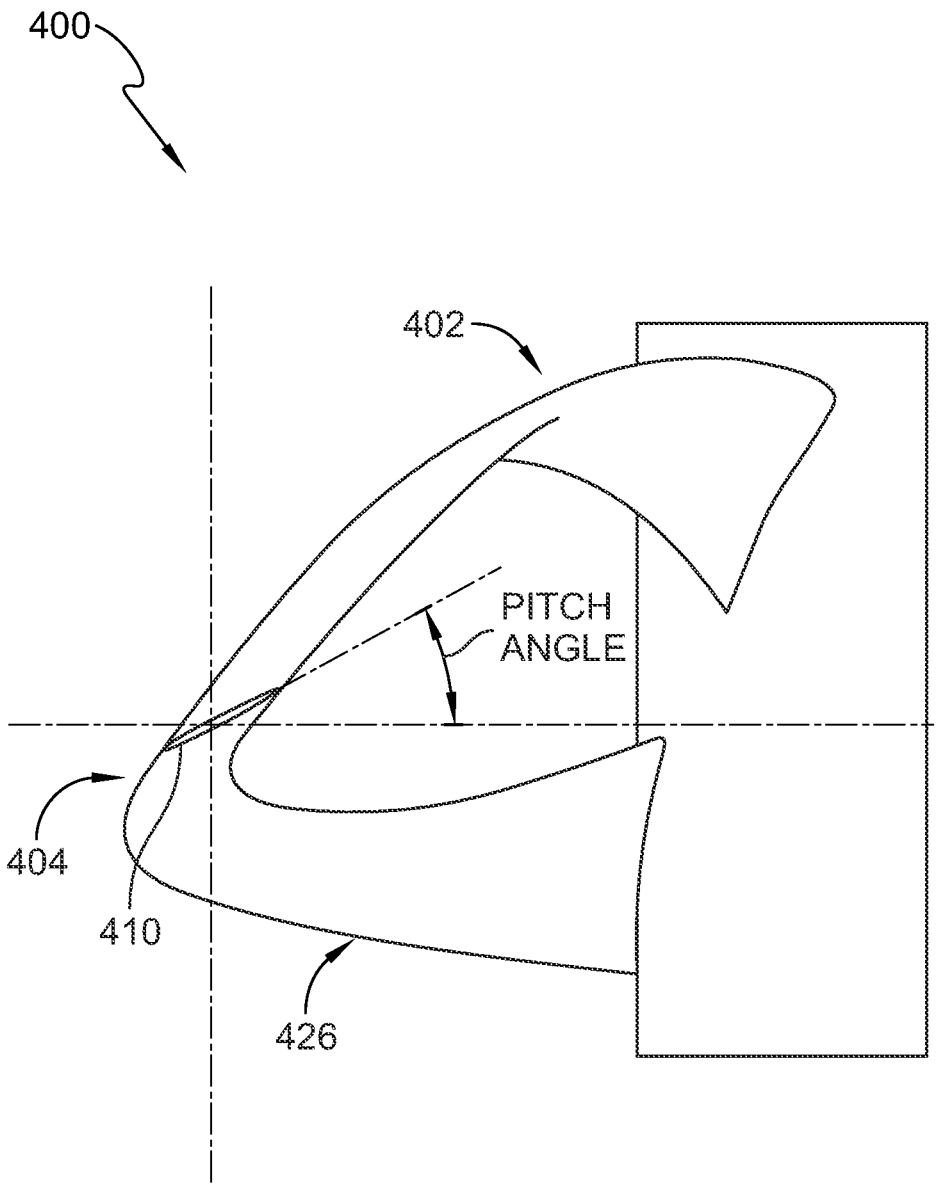
Figure 7E:
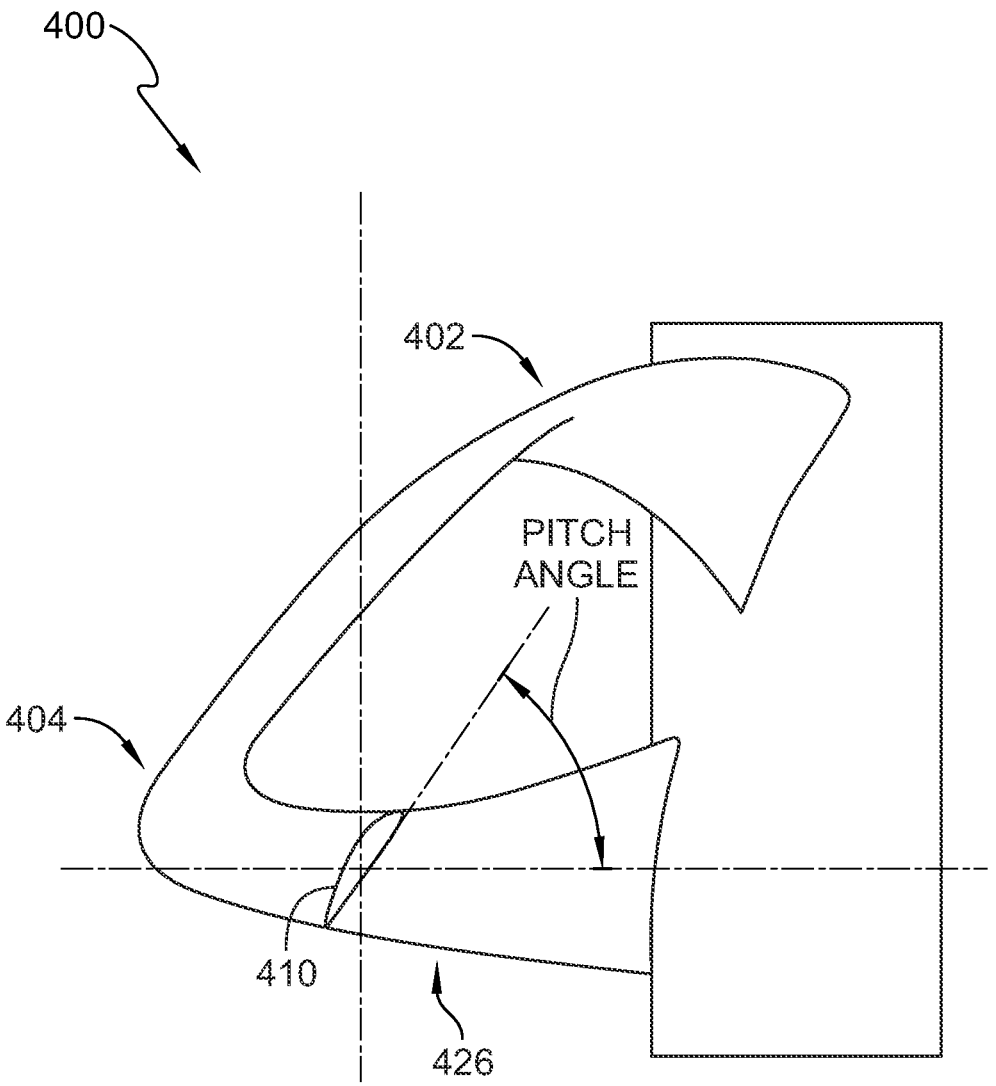
Figure 7F:
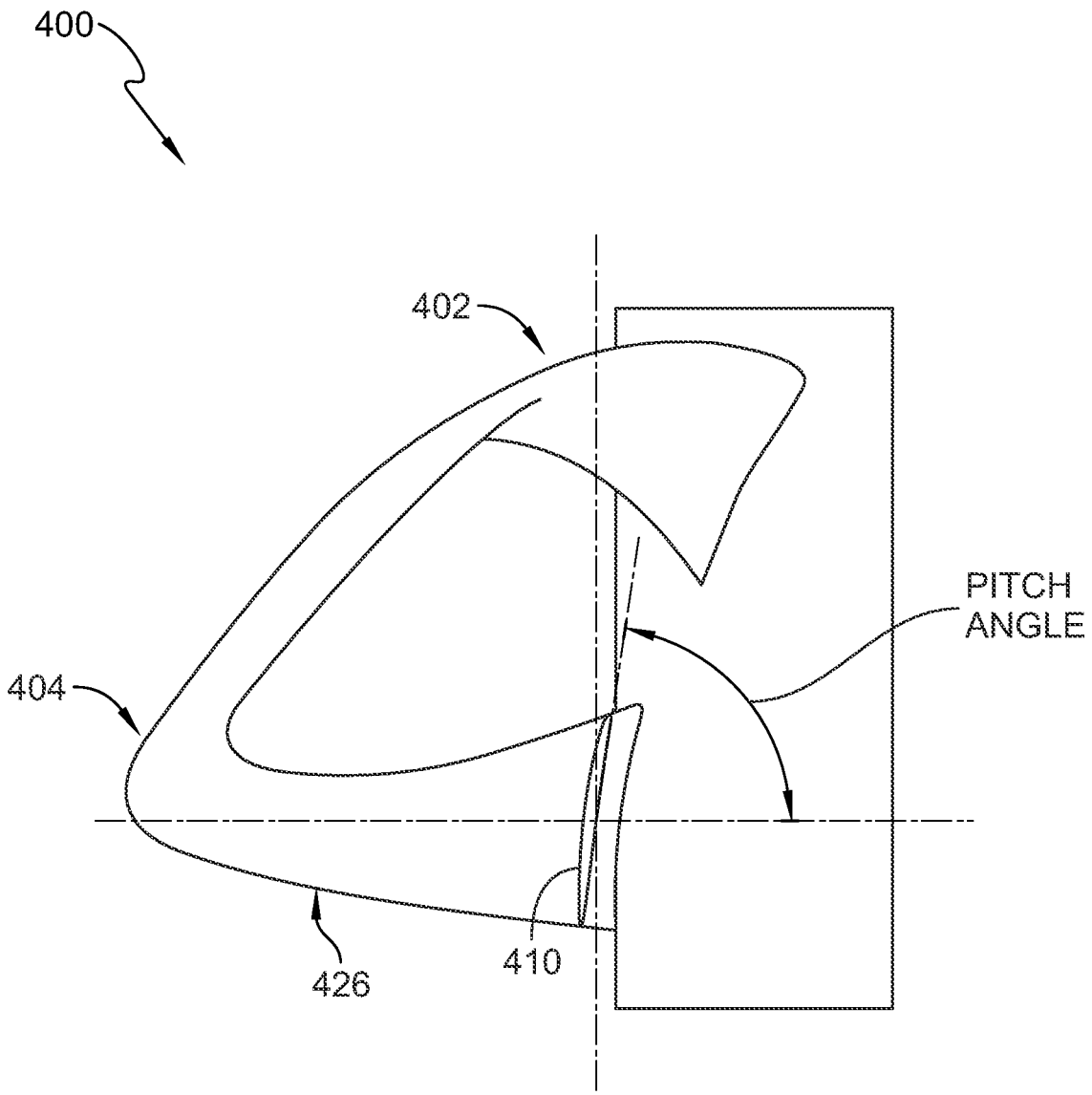

FIGS. 5A-F depict blade 400 viewed along the blade rotational axis X. FIGS. 5A-F identify representative parameter section radii and skew angle. FIGS. 5A-F generally can be applied to any of the blade or propeller embodiments described herein. FIG. 5A depicts the radius of parameter section 412 in the intake portion 402 of blade 400. FIG. 5B shows the radius of parameter section 414, a parameter section in intake portion 402 of blade 400 further from intake root 406 than parameter section 412. FIGS. 5C and 5D depict radii for parameter section 418 and 420, respectively, wherein parameter section 418, 420 are in tip portion 404. FIGS. 5E and 5F depict radii for exhaust parameter section 422 and 424, respectively, both within exhaust portion 426. The position of parameter sections 412, 414, 418, 420, 422 and 424 as being in intake portion 402, tip portion 404, or exhaust portion 426 are provided only for ease of discussion. The actual parameter values and resulting fluid flow may define the positions of the sections otherwise.

FIGS. 5A-F show skew angle of parameter sections 412, 414, 418, 420, 422, 424. Skew angle is the projected angle from a line through midpoint 410 of chord 314 to the generating line, in this illustrative embodiment the Y-axis looking along hub axis 103 (X-axis).

FIGS. 6A-D, in addition to depicting skew angle and radius, depict parameter section vertical angle, alpha, labeled on each of FIGS. 6A-D. FIGS. 6A-D generally describe various parameters of a propeller blade and can be applied to any of the blade or propeller embodiments described herein. Vertical angle may also be referred to as "lift angle." Alpha is the angle that the parameter section is rotated relative to a line perpendicular to the skew line, which is identified in FIGS. 6A-D. The aforementioned skew line refers to the line together with the zero skew line that forms the skew angle. Depending on the value of Alpha, the nose of the parameter section will either be "lifted" or will "droop" from a line perpendicular to the skew line that forms the skew angle with respect to the zero skew line, wherein the zero skew line is coincident with the Y-axis of the coordinate system identified on FIGS. 6A-D.

Various illustrative embodiments will be described by combinations of characteristics. The disclosed propeller includes different combinations of the characteristics, equivalents of the elements and may also include embodiments wherein not all characteristics are included.

FIGS. 7A-F provide a schematic representation of pitch angle for various parameter sections. Pitch angle varies throughout the blade with the largest values occurring at the intake and exhaust roots.

Embodiments of single propellers will be described that can be used individually or in combination to form duo-propellers.

FIGS. 8A, 8B depict a propeller 500, that will be referred to as a "Type 1" propeller. FIGS. 8A, 8B depict an isometric view, and a view from the forward end, respectively. FIGS. 9A, 9B depict a propeller 600, that will be referred to as a "Type 2" propeller. FIGS. 9A, 9B depict an isometric view, and a view from the forward end, respectively.

FIGS. 10-13 depict illustrative combinations of propellers to form a CR propeller, such as CR propeller 100. Each of the CR propellers have the parts identified in generic CR propeller 100 shown in FIG. 1. These include at least in part, forward propeller 102, aft propeller 104, blades 106*a*, 106*b*, 106*c*, blades 108*a*, 108*b*, 108*c*, trailing edge 110, leading edge 112, and propeller axis 103. CR propeller 100 may be formed from the combination of a Type 1 propeller 500 and Type 2 propeller 600, with the Type 1 propeller 500 positioned aft of the Type 2 propeller 600, as shown in FIG. 10. The forward propeller has high rake (R2) and the aft propeller has a minimum rake R0. FIG. 11 shows another illustrative CR propeller 100, in which a Type 1 propeller 500 is forward of a Type 2 propeller 600. Both the forward propeller and aft propeller of FIG. 11 have a high rake R2. Alternatively, CR propeller 100 may be formed from the combination of two Type 2 propellers 600, such as shown in FIG. 12, wherein both the aft and forward propellers have a high rake R2, or two Type 1 propellers 500, such as shown in FIG. 13, where the forward propeller has a high rake R2, and the aft propeller has a low rake of R. A Type 3 blade form is also feasible but not shown. Not shown but implied are all R0, R1, & R2 variants of T1 and T2 styles, and all forward and aft position permutations. T3 blade form is also feasible.

FIGS. 14, 15 and 16 depict Type 1, Type 2 and Type 3, propellers, respectively. Lines through the roots of each propeller blade show the direction of the wakes created by the blades.

As depicted in FIG. 14, a blade of the Type 1 propeller 500 has the inlet root section 502 positioned axially forward and rotationally forward of the outlet root section 504. The paths of the Type 1 inlet blade wake 506 and outlet blade wake 208 are substantially parallel and not prone to crossing one another. The trailing wake is particularly important for this type of propeller because it has a strong influence on the water flowing over the outlet portion of the blade. The outlet portion is designed to operate in, or very close to, the wake sheet coming off the inlet trailing edge. Placement of the outlet portion with respect to the wake sheet coming off the inlet trailing edge is selected to optimize the propeller's performance to the extent that position can be balanced with other design requirements. In an illustrative embodiment, an application-specific propeller is made by selecting the type of propeller, such as Type 1, Type 2 or Type 3. The selected type determines where the inlet and outlet roots are positioned on the hub relative to one another. For example, for a Type 1 propeller, the outlet root will be close to the extended chord line of the inlet root, such as shown in FIG. 14. In a further example, for a Type 3 propeller (as will be described below) the outlet root will be near the same axial location as the inlet root and will not be near the extended chord line, as shown in FIG. 16.

As shown in FIG. 15, Type 2 propeller 600 has the inlet section of the blade root section 602 disposed upon hub 610 in about the same axial position as the outlet root section 604 and is rotationally behind the outlet root section 604. Like with the Type 1 propeller 500, for the Type 2 propeller the paths of the inlet blade wake 606 and outlet blade wake 608 blade wake are substantially parallel and not prone to crossing one another. The distinction between the Type 1 and Type 2 propeller is related to the axial position of blade roots. The trailing wake is less important for this propeller type because the outlet section does not operate near the inlet section trailing wake. For the Type 2 propeller 600 the design of the tip is prioritized over the placement of the outlet portion with respect to the wake sheet coming off the inlet trailing edge.

In conventional CR propellers, the forward propeller is larger in diameter and has a different number of blades than the aft. For propellers disclosed herein, the forward and aft propellers may have the same diameter, different diameters, the same number of blades, or different numbers of blades, or a combination thereof. An illustrative range of diameter differences includes, the aft propeller having a diameter in the range of 80%-100% of the forward propeller. In a further illustrative range, the aft propeller has a diameter in the range of 100%-130% of the forward propeller. When accounting for non-cylindrical hubs an illustrative range of diameter differences includes, the aft propeller having a diameter in the range of 33%-100% of the forward propeller.

In a further illustrative range, the aft propeller has a diameter in the range of 100%-175% of the forward propeller.

A key parameter to optimize the propeller's performance is the blade-to-blade distance D between the propellers. This is measured parallel to the hub axis from the trailing edge 110 of the forward blade to the leading edge 112 of the aft blade. Blades on the aft propeller must clear the blades on the forward propeller as they rotate in opposite directions. Additionally, the axial blade-to-blade distance D, together with other parameters affects efficiency. In a particular embodiment, optimally the blade-to-blade distance is as small as possible, with the limiting factor being a minimum allowance to prevent collision.

Another general propeller parameter of importance is the axial length and space required for the blade and hub to fit the engine configuration and boat hull architecture. Axial Length and space required for a propeller is constrained by aftward placement of the rudder, and forward proximity to the hull and shaft bearings. Additionally, the total length of the system may be constrained by the position and length of the anti-ventilation plate.

Other key parameters include rake and skew, which are selected for each spanwise portion of the blade to create the inventive contra-rotating propeller.

The disclosed propeller types are less constrained than standard propellers in a contra-rotating system. For example, the downstream wake system of a three bladed loop propeller behaves like the weaker downstream wake system of a six-bladed propeller, which typically is favorable because the after propeller blades experience smaller wake extremes (6 weaker vs 3 stronger).

The disclosed propellers have improved efficiency because the tip portions reduce the required torque. The tip also changes the water flow over the inner parts of the blade so that the inner parts are more efficient by producing more thrust and or less torque.

Propeller 100, and combinations of propellers 500, 600 are all shown with three blades on each of the forward propeller and aft propeller. As noted above, the number of blades can be greater than three. Additionally, the number of blades on the aft propeller may be different from on the forward propeller. For example, the number of blades on the forward propeller may be selected from 2, 3, 4, 5, 6 and 7 and the number of blades on the aft propeller may be selected from 2, 3, 4, 5, 6 and 7, allowing for any combination between the number of blades on the forward propeller and the number of blades on the aft propeller. The inventive contra-rotating propeller may include any combination of blade or propeller styles, for example, Type 1 propellers 500 or Type 2 propellers 600, various number of blades and various combination of diameters.

The inventive CR propeller has unique parameters, such as:

- position of the inlet and outlet portions of the blade relative to each other.
- Skew and Rake for each element of the blade: Inlet, tip/loop region, outlet.

In illustrative embodiments of the duo-propeller, the locations and strength of the blade trailing wake are selected to achieve the desired forces on the propeller.

As depicted in FIG. 16, for the Type 3 propeller 700 the inlet root section 702 is positioned axially forward of the outlet root section 704. The inlet root wake 706 may cross the outlet wake 708, or may cross the outlet portion of the blade itself. The water flows from the top to the bottom in FIGS. 14-16 and the wake flows with the water. In FIG. 16, the wake coming off the inlet root 702 passes to the right of the outlet root 704. The wake coming off the outlet (bottom left cusp) goes further down and to the left.

FIG. 17 depicts a right-handed, right loop propeller, showing various possible positions of the inlet root for Type 1, Type 2 and Type 3 propellers 500, 600, 700. As used herein, a right-handed propeller rotates clockwise in forward gear. Clockwise rotation is as when viewed from the rear of a vessel. The wake of the outlet root is also shown by lines 120, 122, 124. The wakes 506, 606 generated by inlet roots 502, 602, respectively are substantially parallel to the wakes 508, 608 generated by the outlet roots 504, 606 for Type 1 and Type 2 propellers. The wake 706 generated by the Type 3 blade inlet root would cross over the wake 408 generated by the outlet blade root 404.

For a duo-propeller, the strength of the trailing wake off the forward propeller typically strongly affects the aft propeller through axial acceleration and swirl. The aft propeller typically has a smaller effect on the forward propeller through axial acceleration. When the aft propeller turns in the opposite direction from the forward propeller, it does not always operate in the same relative position to the forward propeller trailing wake, so the location of the wake may be less important.

Embodiments of the duo-propeller provide increased swirling compared to conventional propellers and enhanced ability for the aft propeller to capture the energy lost to the swirling flow of the forward propeller's outflow. The aft propeller is configured to utilize that outflow to improve overall system performance. The amount of swirl energy generated by the forward propeller depends in part on the loading at the tip of the propeller blades. Unlike a conventional propeller, the amount of feasible loading near the tip is not limited by the creation of tip vortices that can cause drag. This is accomplished by providing rake and skew that create a loop blade with a tip portion that has little or no vortices. Additionally, disclosed propeller designs reduce the interference of the fluid flow generated by the forward propeller with the efficiency of the aft propeller. Thus, there the standard limitations on the diameter of the aft propeller in relation to the forward propeller do not apply. This allows the aft propeller to be larger or equal in diameter to the forward propeller, although the duo-propeller would still have efficiency advantages over conventional duo-propellers if the aft propeller and forward propeller were of equal diameter.

In illustrative embodiments of the propeller, the generation and recovery of swirl energy is largely controlled by pitch and camber or camber/cord. The loop shape at the tip also can contribute to the generation and recovery of the swirl energy. An illustrative range of pitch angle is 0 to +75 degrees. An illustrative range of camber/cord is −0.2 to +0.2. In general the higher the pitch angle and/or the camber, the higher the loading. As noted herein, the tip shape is largely described by the skew and rake working together.

In an illustrative embodiment of the propeller, the inlet roots and outlet roots are positioned to optimize propeller strength, while the design parameters of other portions of the inlet and outlet blade sections and the tip portion are focused on performance, such as efficiency. For a single propeller, roots may be placed to increase stress margins to improve or maximize structural integrity. By improving the stress margins via root placement, the design of the other parts of the blade can focus on higher efficiency, even if parameters of those parts do not maximize structural integrity. In other words structural integrity is prioritized in root placement while hydrodynamic performance is emphasized elsewhere on the propeller blades.

Two props—The relative position of the blade roots (outlet of the forward propeller and Inlet of the after propeller) may only have an effect hydrodynamically if they dictate other propeller parameters to accommodate the positions. However, with conventional propellers there are high stresses at the roots. The Type 1 and Type 2 propeller shapes reduce those stresses, typically making them fundamentally stronger than conventional propellers.

Additional parameters are the vertical angle that orients each blade section nose-tail line relative to the shaft axis and the roll angle that orients the blade section relative to the hub. In an illustrative embodiment, the roll angle is near 0° at the inlet root to near 90° at the tip and near 180° at the outlet root.

The rake, skew, vertical angle and roll angle work together to make the loop shape. The resulting loop shape of the propeller embodiments reduce cavitation at the tip, thus loosing less energy than a conventional propeller. The disclosed propellers generate more thrust near the tip than conventional propellers. Additional loading at the tip creates a more efficient propeller.

The propellers of the disclosed duo propeller nest so that the leading edge of the after propeller inlet roughly follows the trailing edge of the forward propeller outlet trailing edge.

The aft propeller of a duo propeller according to an illustrative embodiment of the invention has parameters that account for water acceleration created by the forward propeller. Additionally the forward propeller is created based on parameters that take into account water acceleration created by the aft propeller.

Illustrative ranges of key parameters for Type 1, Type 2 and Type 3 propellers and other propellers that can be used for forward or aft propeller in a CR propeller are as follows. An illustrative range for skew is −135 degrees to +135 degrees. A further illustrative range is −120 degrees to +120 degrees.

An illustrative range of rake is −0.9 OD to +0.9 OD. A further illustrative range is −0.7 OD to +0.7 OD. And yet another illustrative range is +0.5 OD to +0.5 OD.

An illustrative range of rake angle (measured from average of inlet and outlet roots as shown by the dash-dot line in FIGS. 23 and 24) is −60 degrees to +60 degrees. A further illustrative range is −45 degrees to +45 degrees. FIGS. 23 and 24 illustrate low and high rake angle, respectively. Zero rake is referred to here as "neutral rake." In FIG. 23, ranges of positive and negative rake angles are indicated on either side of neutral rake. The dash-dot line indicates the rake angle value for this particular propeller. Similarly, FIG. 24 indicates a rake angle for a different propeller.

General rake angles may be referred to as low rake, high rake, moderate rake and negative rake. Low rake may be for example, 0-15 degrees, moderate rake may be for example, 15-30 degrees, and high rake may be for example 30-45, or higher. In an illustrative embodiment, negative rake is from zero to −45 degrees. Illustrative ranges of vertical angle include −60 degrees to +60 degrees. A further illustrative range is −45 degrees to +45 degrees.

In an illustrative embodiment of the invention, rake increases from the inlet root to the propeller tip portion. It may either increase or decrease from the tip to the outlet root. Similarly, in an illustrative embodiment skew increases from the inlet root to the tip.

Both rake and skew may go down a little from the inlet root out a bit before increasing towards the tip, on average it is increasing from the inlet root to the tip portion. Similarly, skew may decrease initially starting from the root but before increasing toward the tip. In both cases in these illustrative embodiments, on average skew and or rake will increase from the root to the tip.

FIGS. 18A-C depict Type 1, Type 2 and Type 3 blade types, 500, 600, 700, blade loop directions and blade rake types with additional detail Propellers 500, 600, 700 are shown having right-handed rotation, right handed loop direction and a low rake ("R0"). "Up" on the diagrams is "forward." For left-handed propeller rotation all propellers shown would be mirrored about the axis of rotation.

As shown in FIGS. 18A, the Type 1 inlet wake 506 and the Type 1 outlet wake 508 do not cross and the inlet root 502 and the outlet root 504 are positioned differently along the length of the hub 510, i.e. at different axial levels. As shown in FIG. 18B the Type 2 inlet wake 606 and the Type 2 outlet wake 608 do not cross and the inlet root 602 and the outlet root 604 are at the same along the length of the hub, i.e. at the same axial level. As shown in FIG. 18C the Type 3 inlet wake and the Type 3 outlet wake cross and the inlet root 702 and the outlet root 704 are at different levels along the length of the hub 710, i.e. at the different axial locations.

FIGS. 19A, 19B show the blade loop direction for a Type 1 propeller. Again, propeller rotation is right handed, up is forward and all have R0, i.e. low rake. The Type 1 propeller 500 with a right handed loop shows inlet root 502 to the right of outlet root 504. For the Type 2 propeller 600, there would not be much difference between the right hand loop and the left hand loop because the inlet root 302 and outlet root 304 have similar axial locations. The Type 1 propeller 500 with a left-handed loop shows inlet root 502 to the left of outlet root 504.

FIGS. 20A, 20B illustrate rake type, as either low or high. Although elsewhere rake ranges have been categorized as low, moderate or high, here rake is broken down into just low and high, where low may be for example 0-25 degrees and high rake may be for example 25 degrees to 45 degrees. Low rake, R0, is shown in FIG. 20A wherein an illustrative example of the mean rake angle is diagrammed. Rake values R0.5, R1.0, R 1.5 etc. are other possible rake values. FIG. 20B illustrates an example of high rake, R2. Illustrative variants of the Type 1 propeller 500, Type 3 propeller 600 and Type 4 propeller 400 include:

Type 1 R0 Left-Hand Loop
Type 1 R0 Right-Hand Loop
Type 1 R2 Left-Hand Loop
Type 1 R2 Right-Hand Loop
Type 2 R0
Type 2 R2
Type 3 R0 Left-Hand Loop
Type 3 R0 Right-Hand Loop
Type 3 R2 Left-Hand Loop
Type 3 R2 Right-Hand Loop Right-handed propellers may be mirrored to create left-handed propellers and vice versa (the loop direction would also be mirrored).

A duo propeller can be constructed with any combination of the above-listed propeller types. The selected combination will be in part chosen by the compatibility of the two propellers or the performance effect of combining them.

Illustrative nomenclature provides for a general classification for rake by magnitude that represents the net rake for an entire blade, independent of the individual blade section rake values. The nomenclature is R0 for the least amount of collective rake, and R1, R2, etc. for increasing values of rake. FIG. 23 shows a propeller with a relatively low rake designated as R0. FIG. 24 shows a propeller with a relatively high rake designated as R2. Numerical values between 0 and 2 indicate rake values between what is shown for R0 and R2.

FIGS. 21A, 22B depict cross-sections of a CR propeller showing an illustrative gear assembly that can be employed to rotate both propellers. The gear assembly is driven by a single motor and imparts counter rotational motion to the two propeller of the CR propeller.

FIG. 22 depicts an illustrative through-hub exhaust propeller 900 that can be used on outboards and sterndrives. Any of the disclosed propellers may have through-hubs. Through-hub exhaust propeller 900 has a through-hub 902 that consists of cylindrical barrel 904 to which blades 906*a*, 906*b* and 906*c* are attached. This allows exhaust to flow through barrel 904, exiting at the barrel aft end 908, thus not interfering with water flow around and through blades 906*a,b,c*. Through-hub exhaust propeller 900 may be a components of a CR propeller. Blade configurations disclosed herein can also be used on non-through-hub exhaust propellers, over-hub exhaust propellers and over/through hub exhaust propellers. Not all contra-rotating propellers involve exhaust. For large vessels and pod-drive systems, there is no provision for exhaust flow. It is noted that the perforated background is not a part of the propeller.

Illustrative propeller styles include:

Outboard: having a Ø15" and 3 blade

Freighter: Ø9.8 m having 3 blade

Azimuth thruster wherein the propeller is connected directly to the motor shaft for rotation about a vertical axis (such as ABB's AZIPOD®): having Ø3.3 m and 3 blades Motor Yacht: having Ø31" and 4 blades.

Although illustrative numbers of blades are noted above, each style may have 2, 3, 4 or 5 blades. Pitch and any blade area ratio values may be varied depending on specific use and performance requirements.

Applications of the propellers are not limited to small size or outboard motor applications.

Although certain embodiments have been described and illustrated in exemplary forms with a certain degree of particularity, it is noted that the description and illustrations have been made by way of example only. Numerous changes in the details of construction, combination, and arrangement of parts and operations may be made. Embodiments of the invention may each have different combination of elements. The invention includes different combinations of the elements disclosed, omission of some elements or the replacement of elements by the equivalents of such structures. Accordingly, such changes are intended to be included within the scope of the disclosure, the protected scope of which is defined by the claims.

The invention claimed is:

1. A method of increasing propeller efficiency swirl in a duo propeller, the duo propeller comprising a forward propeller and an aft propeller operating in series on co-axial counter rotating shafts, the method comprising:

selecting the diameter of the aft propeller to be in the range of 100% to 175% of the forward propeller, and controlling the generation of swirl energy by the forward propeller and recovery of the swirl energy by the aft propeller by varying the camber and pitch angle (tip loading) while minimizing tip vortices.

2. The method of claim 1 further comprising varying the diameter of the aft propeller to reduce interference of the fluid flow generated by the forward propeller with the efficiency of the aft propeller.

3. The method of claim 1 wherein pitch angle is in the range of 0 to +75 degrees.

4. The method of claim 1 wherein chamber is in the range of −0.2 to +0.2.

5. The method of claim 1 further comprising:

selecting rake values and skew values which together form a loop-shaped blade having an inlet root and an outlet root attached to a hub;

spacing the inlet root and the outlet root part on the hub such that a portion of the hub is part of the loop;

selecting the value of rake to be greater at the tip that at the inlet root; and selecting the value of skew to be greater at the tip that at the inlet root.

6. The method of claim 1 wherein the selected values of skew for at least one of the forward or aft propeller are the range of −135 degrees to +135 degrees.

7. The method of claim 1 wherein the selected values of skew for at least one of the forward or aft propeller are in the range of −120 degrees to +120 degrees.

8. The method of claim 1 wherein the selected values of rake for at least one of the forward or aft propellers are in the range of −0.9 OD to +0.9 OD wherein OD is the outer diameter of the propeller.

9. The method of claim 1 wherein the selected values of rake for at least one of the forward or aft propellers are in the range of −0.5 OD to +0.5 OD wherein OD is the outer diameter of the propeller.

10. The method of claim 1 wherein the selected values of rake angle for at least one of the forward or aft propellers are in the range of −60 degrees to +60 degrees.

11. The method of claim 1 wherein the selected values of rake angle for at least one of the forward or aft propellers are in the range of −45 degrees to +45 degrees.

12. The method of claim 1 further comprising:

designing the duo-propeller as a system including basing the design of the aft propeller in part on water acceleration of the first propeller including wakes created by the forward propeller.

13. The method of claim 1 comprising selecting the diameter of the aft propeller to be in the range of 100% to 130% of the forward propeller.

14. The method of claim 1 comprising configuring the duo-propeller so the forward propeller and the aft propeller nest so that a leading edge of the aft propeller inlet roughly follows an outlet trailing edge of the forward propeller.

15. The method of claim 1 comprising configuring the propeller so an inlet wake path is substantially parallel to an outlet blade wake path for at least one of the forward or aft propellers.

16. The method of claim 1 comprising for at least one of the forward or aft propellers defining rake and skew from an inlet based near an inlet root and determining rake angle from an average of the inlet root and/or an outlet root.

17. A duo propeller comprising:

a forward propeller and an aft propeller operating in series on co-axial counter rotating shafts, wherein the diameter of the aft propeller is within the range of 100% to 175% of the forward propeller; and a pitch angle and camber to optimize generation of swirl energy by the forward propeller and recovery of swirl energy by the aft propeller while minimizing tip vortices.

18. The duo propeller of claim 17 wherein pitch angle is in the range of 0 to +75 degrees.

19. The duo propeller of claim 17 wherein camber/cord is in the range of −0.2 to +0.2.

20. The duo propeller of claim 17 wherein at least one of the forward or aft propeller has skew value in the range of −135 degrees to +135 degrees.

21. The duo propeller of claim 17 wherein at least one of the forward or aft propeller has a skew values in the range of −120 degrees to +120 degrees.

22. The duo propeller of claim 17 wherein at least one of the forward or aft propeller has a rake value i in the range of −0.9 OD to +0.9 OD wherein OD is the outer diameter of the propeller.

23. The duo propeller of claim 17 wherein at least one of the forward or aft propeller has a rake value are in the range of −0.5 OD to +0.5 OD wherein OD is the outer diameter of the propeller.

24. The duo propeller of claim 17 wherein at least one of the forward or aft propeller has a rake angle in the range of −45 degrees to +45 degrees.

25. The duo propeller of claim 17 wherein the diameter of the aft propeller is in the range of 100% to 130% of the forward propeller.

26. The duo propeller of claim 17 wherein the diameter of the aft propeller is in the range of 100% to 175% of the forward propeller.

27. The duo propeller of claim 17 wherein the forward propeller and the aft propeller are nested so that a leading edge of the aft propeller inlet roughly follows an outlet trailing edge of the forward propeller.

28. The duo propeller of claim 17 wherein each of the inlet portion and the outlet portion extend from their respective root to where the blade reference line is in the range of 75% to 100% of the blade outer radius and increasing and the tip portion is the remaining portion between the inlet and outlet portions.

* * * * *